US008833113B2

(12) United States Patent
Lee et al.

(10) Patent No.: US 8,833,113 B2
(45) Date of Patent: Sep. 16, 2014

(54) FABRIC TREATING MACHINE

(75) Inventors: Kyu Bum Lee, Changwon-si (KR); Young Jong Kim, Changwon-si (KR); Young Bae Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 896 days.

(21) Appl. No.: 12/753,357

(22) Filed: Apr. 2, 2010

(65) Prior Publication Data

US 2010/0251784 A1 Oct. 7, 2010

(30) Foreign Application Priority Data

Apr. 3, 2009 (KR) ..... 10-2009-0029138
Jan. 22, 2010 (KR) ..... 10-2010-0006142
Jan. 22, 2010 (KR) ..... 10-2010-0006143

(51) Int. Cl.
*D06B 1/02* (2006.01)

(52) U.S. Cl.
USPC ..... 68/200; 68/23.5; 68/207

(58) Field of Classification Search
CPC ..... D06F 39/088; D06F 58/203
USPC ..... 68/200, 5 C, 23.5, 207; 239/397
See application file for complete search history.

(56) References Cited

U.S. PATENT DOCUMENTS 3,581,529 A * 6/1971 Mitchell et al. ..... 68/222
4,534,512 A * 8/1985 Chow et al. ..... 239/394
5,310,276 A * 5/1994 Bergers et al. ..... 403/349
6,185,774 B1 2/2001 Tubman
2005/0028564 A1 2/2005 Lee et al.
2005/0034488 A1 2/2005 Oh et al.
2005/0284508 A1* 12/2005 Carli et al. ..... 134/57 D
2007/0227201 A1 10/2007 Park et al.
2007/0231047 A1* 10/2007 Parks et al. ..... 401/47
2009/0120140 A1* 5/2009 Choi et al. ..... 68/5 C
2011/0232335 A1* 9/2011 Johnson et al. ..... 68/19

FOREIGN PATENT DOCUMENTS

CN 1109120 A 9/1995
CN 201186999 Y 1/2009
JP 2002-282587 A 10/2002
KR 20080056627 A * 6/2008 ..... D06F 58/04

OTHER PUBLICATIONS

KR20080056627A Machine Translation.*

* cited by examiner

*Primary Examiner* — Michael Kornakov
*Assistant Examiner* — Marc Lorenzi
(74) *Attorney, Agent, or Firm* — Birch, Stewart, Kolasch, Birch, LLP

(57) ABSTRACT

A fabric treating machine includes a spray nozzle for spraying water supplied from a water supply passage into an inner tub and a spray nozzle combining unit for combining the spray nozzle with a case. Fabric loaded in the inner tub can be effectively soaked through the spray nozzle. Furthermore, a spray direction of the spray nozzle can be accurately adjusted when the spray nozzle is fitted in the case, and thus the spray nozzle can be easily fitted in the case and water sprayed through the spray nozzle can be prevented from overflowing.

13 Claims, 21 Drawing Sheets

(a) No load (b) Full load $d_2 < d < d_1$

FABRIC TREATING MACHINE

BACKGROUND OF THE INVENTION

1. Field of the Invention

The present invention relates to a fabric treating machine, and more particularly, to a fabric treating machine including a spray nozzle for spraying washing water to evenly soak fabric loaded in an inner tub so as to improve washing and rinsing performances.

2. Discussion of the Related Art

In general, fabric treating machine include a washing machine for removing contaminants stuck to clothes, beddings and the like (hereinafter, referred to as "fabric") by using water, detergent and a mechanical action, a drying machine for drying wet fabric using dried hot air heated by a heater and a mechanical action, and a washing/drying machine having both a washing function and a drying function.

The washing machine can be classified into a top load type washing machine that has a fabric entrance formed at the top of a cabinet thereof and washes fabric according to revolving water flow generated when an inner tub is rotated and a drum type washing machine that has a fabric entrance formed at the front side of a cabinet thereof and washes fabric according to fabric fall occurring when a drum is rotated.

A conventional top load type washing machine includes a cabinet that forms the external appearance of the washing machine and has an opened top face, a top cover that is combined with the opened top face of the cabinet and has a fabric entrance formed therein, a door mounted to rotate on the fabric entrance, a base disposed at the bottom of the cabinet, an outer tub disposed in the cabinet for containing water therein, an inner tub located in the outer tub for washing fabric, a motor unit located under the inner tub to rotate the inner tub, a water supply unit for supplying water into the outer tub, and a drain unit for draining water from the outer tub. Furthermore, the washing machine includes a detergent supply unit connected to the water supply unit to supply detergent with water.

However, in the conventional top load type washing machine, the water supply unit and the detergent supply unit are disposed at one side of the top of the cabinet, and thus washing water supplied from the water supply unit and the detergent supply unit is provided to only a lower part of one side of the inner tub. Accordingly, fabric is not evenly soaked. In this case, washing and rinsing performances are deteriorated.

SUMMARY OF THE INVENTION

It is an object of the present invention to provide a fabric treating machine for evenly soaking fabric using a spray nozzle to improve washing and rinsing performances.

To accomplish the object of the present invention, there is provided a fabric treating machine including a case having a fabric entrance formed at the top thereof, an inner tub disposed in the case, a water supply unit for supplying water to the inner tub from the outside of the case, a spray nozzle for spraying the water supplied from the water supply unit into the inner tube, and a spray nozzle combining unit for controlling a spray direction of the spray nozzle to be within a predetermined spray range and combining the spray nozzle with the case.

The predetermined spray range may restrict a highest point on the inner sidewall of the inner tub that water sprayed through the nozzle spray reaches, and the spray nozzle combining unit may adjust an angle of a nozzle of the spray nozzle rotating toward the inner sidewall of the inner tub from the vertical direction so as to control the highest point on the inner sidewall of the inner tub that the water reaches.

The spray nozzle combining unit may be combined to rotate with the case at a predetermined angle and the spray direction of the spray nozzle may be adjusted according to the rotating angle.

The spray nozzle combining unit may include a nozzle cap covering the spray nozzle, and a part of the nozzle cap may be inserted into the case, rotated at a predetermined angle and then fixed.

The case may have a slit formed therein and the nozzle cap may have a combining protrusion inserted into the slit and bent in the rotating direction of the nozzle cap.

The case may have a fixing hole formed therein, in which the end of the combining protrusion rotated along the slit is fixed.

The case may have a plurality of fixing holes formed therein at predetermined intervals and the combining protrusion may be selectively fixed in one of the plurality of fixing holes according to the rotating angle of the nozzle cap.

The spray nozzle combining unit may include a combining protrusion projected from the spray nozzle, inserted into the case, rotated at a predetermined angle and fixed.

The spray nozzle combining unit may include a first combining unit disposed in one of the spray nozzle and the case and inserted into the other in a forward/backward direction to guide the spray nozzle to a fitting position when the spray nozzle is fitted in the case and fixed in the forward/backward direction when the spray nozzle is rotated at a predetermined angle to prevent the spray nozzle from moving in the forward/backward direction, and a second combining unit disposed in one of the spray nozzle and the case, inserted into the other according to elasticity and fixed in the rotating direction of the spray nozzle when the spray nozzle is rotated at a predetermined angle to restrict the rotating angle of the spray nozzle.

The first combining unit may include a rear protrusion formed on the spray nozzle and protruded backward toward the case, and a rear protrusion combining hole formed in the shape of an arch in the case such that the rear protrusion is inserted into the rear protrusion combining hole and rotated along the arch at a predetermined angle.

The length and position of the rear protrusion combining hole may be set in advance according to an angle of the nozzle of the spray nozzle facing the inner sidewall of the inner tub.

The rear protrusion combining hole may include an insertion part into which the rear protrusion is inserted in the forward/backward direction and a rotating part extended from the insertion part in the rotating direction of the spray nozzle to form an arch shape. The area of the rotating part is smaller than that of the insertion part.

The second combining unit may include an elastic protrusion formed on the spray nozzle and having elasticity in the forward/backward direction, and an elastic protrusion combining hole formed in the case in the shape of an arch such that the elastic protrusion is inserted into the elastic protrusion combining hole and fixed in the rotating direction of the spray nozzle after the spray nozzle is rotated at a predetermined angle.

One face of the elastic protrusion may be connected to the spray nozzle to form a connecting part and three faces of the elastic protrusion may be cut to form an elastic part having elasticity in the forward/backward direction.

The elastic protrusion may be bent such that the end of the elastic part of the elastic protrusion is projected backward.

The cross section of the elastic protrusion may decrease as the spray nozzle is rotated.

The spray nozzle may include a tube fitted in the case and the first combining unit may include a radius protrusion protruded from the tube in the direction of the radius of the tube and a radius protrusion hole formed in the case. The radius protrusion is inserted into the radius protrusion hole.

To accomplish the object of the present invention, there is provided a fabric treating machine including a case having a fabric entrance formed at the top thereof, an inner tub disposed in the case, and a spray nozzle disposed in the case and spraying washing water downward to the bottom and inner sidewall of the inner tub, wherein a projection is formed at a lower portion of the front face of the spray nozzle and is further protruded than the front side of the case to prevent the washing water sprayed downward from flowing over the front side of the case.

The projection may be inclined at a predetermined angle to the front side of the case.

The fabric treating machine may further include a nozzle cap covering the spray nozzle, wherein a predetermined gap is formed between the spray nozzle and the nozzle cap and washing water sprayed through the spray nozzle is prevented from flowing over the nozzle cap.

In the fabric treating machine according to an embodiment of the present invention, which includes the spray nozzle for spraying water supplied from the water supply passage into the inner tub and the spray nozzle combining unit for combining the spray nozzle with the case, the spray nozzle can be fitted in the case such that the spray range of the spray nozzle falls in a predetermined range, and thus it is easy to rotate the spray nozzle at a predetermined angle to the inner sidewall of the inner tub and fit the rotated spray nozzle in the case. Accordingly, washing water can be sprayed to the bottom and the inner sidewall of the inner tub and fabric can be effectively soaked to improve washing and rinsing performances.

Furthermore, the spray nozzle can be easily fitted in the case and securely combined with the case to improve reliability and stability.

Moreover, the spray nozzle is disposed such that the spray nozzle sprays water in a most suitable spray direction, and thus water sprayed through the spray nozzle can be prevented from overflowing and fabric can be effectively soaked.

In addition, the fabric treating machine according to another embodiment of the present invention includes the first combining unit fitted in the forward/backward direction when the spray nozzle is fitted in the case and fixed in the forward/backward direction when the spray nozzle is rotated at a predetermine angle to guide the spray nozzle to a fitting position thereof and prevent the spray nozzle from moving in the forward/backward direction after fitted in the case.

Furthermore, the fabric treating machine according to another embodiment of the present invention includes the second combining unit that is fitted in the case according to elasticity and fixed in a rotating direction of the spray nozzle when the spray nozzle is rotated at a predetermined angle, and thus the rotating angle of the spray nozzle can be restricted and the spray nozzle can be prevented from moving in the rotating direction.

Moreover, in the fabric treating machine according to another embodiment of the present invention, the spray nozzle has the projection formed at a low portion of the front face thereof and further protruded than the front side of the case to prevent washing water sprayed through the spray nozzle from overflowing the case to change the washing water spray direction when water pressure is low or an amount of water supply is small.

In addition, a predetermined gap is formed between the spray nozzle and the nozzle cap in the forward/backward direction, and thus washing water sprayed through the spray nozzle can be prevented from flowing along the surface of the nozzle cap to change the washing water spray direction.

DETAILED DESCRIPTION OF THE PREFERRED EMBODIMENTS

A top load type washing machine (referred to as 'washing machine' hereinafter) will now be explained as an embodiment of a fabric treating machine according to the present invention with reference to the attached drawings.

Figure 1:
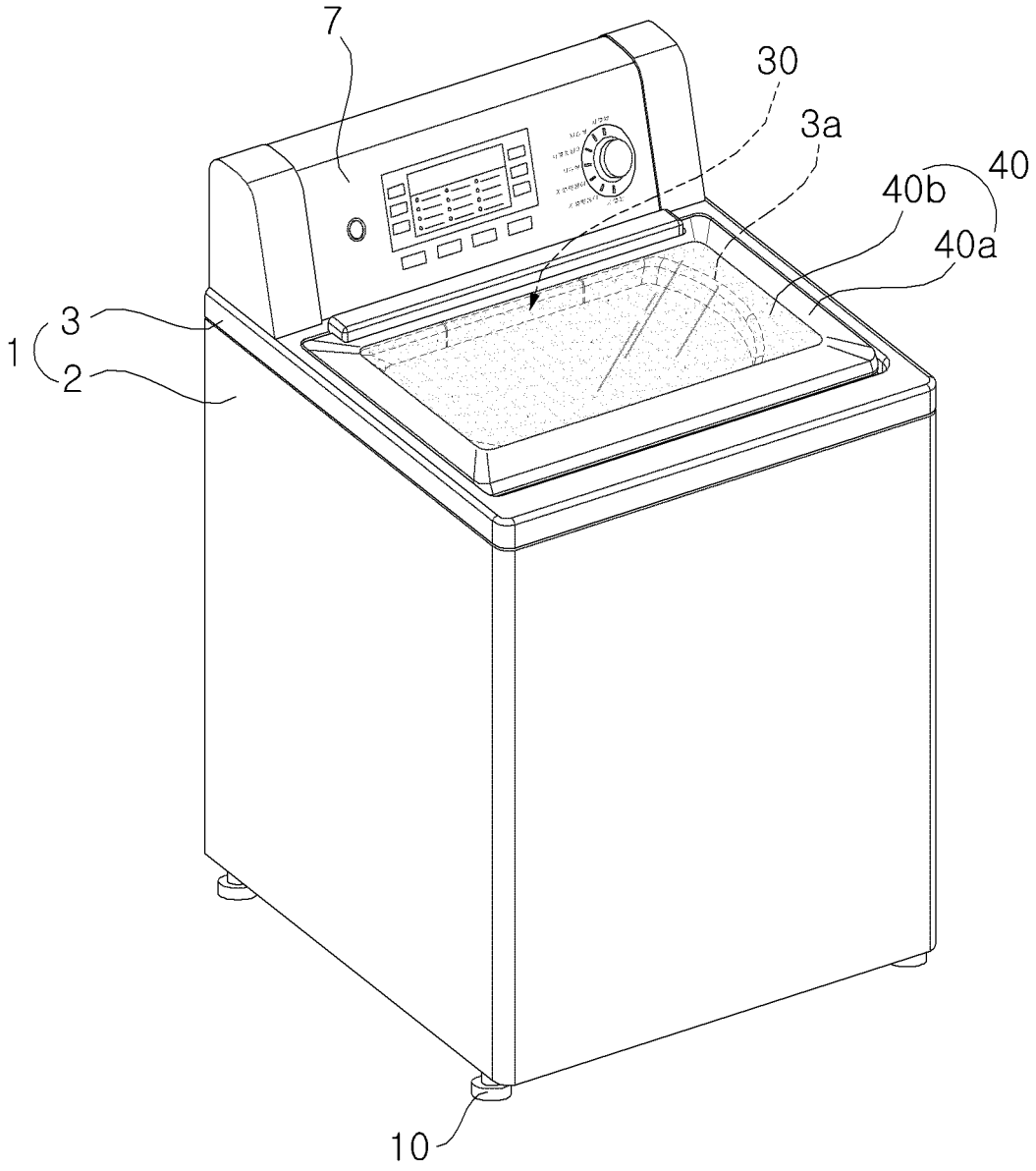
FIG. 1 is a perspective view of a top load type fabric treating machine according to the first embodiment of the present invention.
Figure 2:
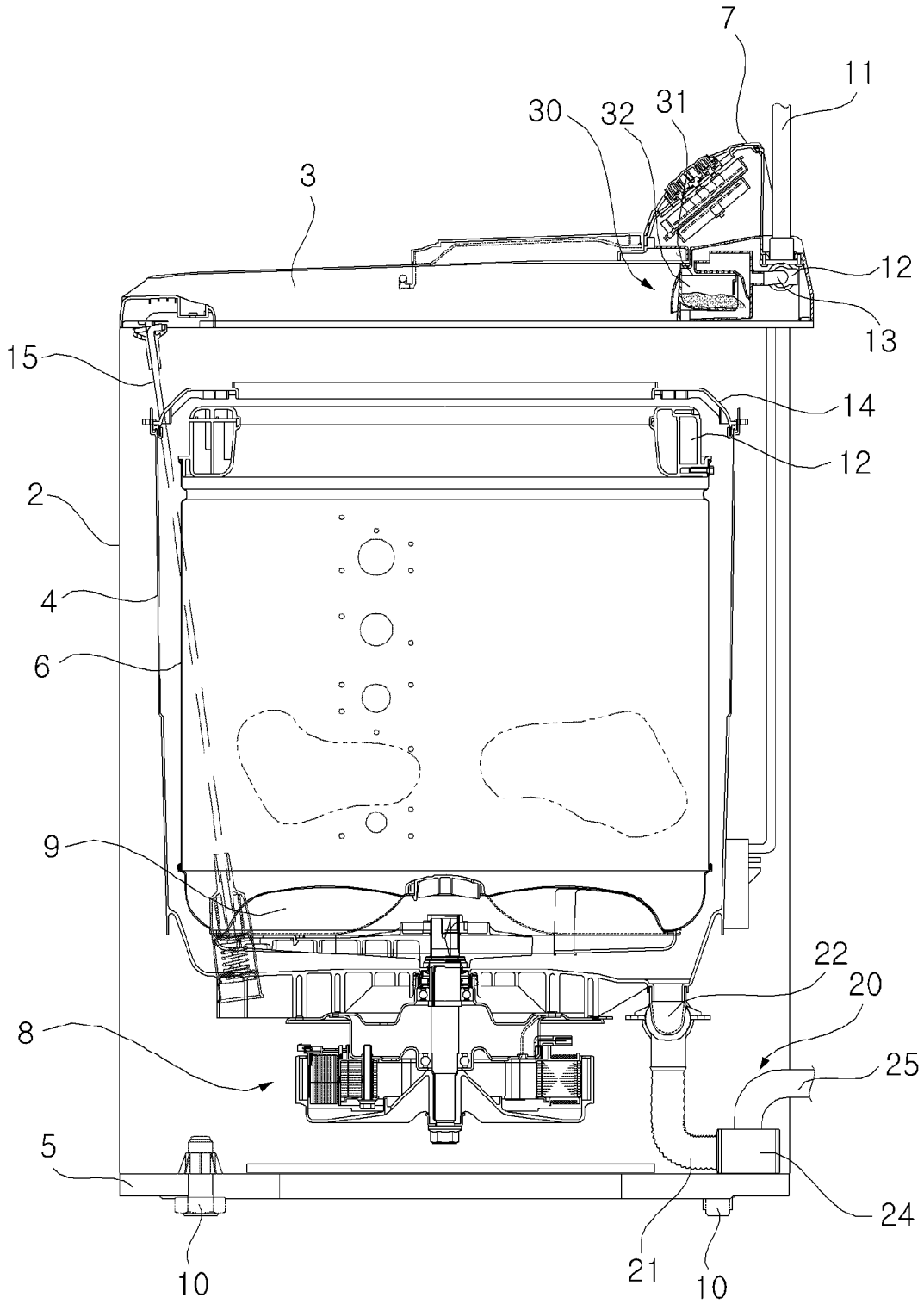
FIG. 2 is a cross-sectional view of the top load type fabric treating machine shown in FIG. 1.

FIG. 1 is a perspective view of a washing machine according to a first embodiment of the present invention and FIG. 2 is a cross-sectional view of the washing machine shown in FIG. 1.

Referring to FIGS. 1 and 2, the washing machine according to the first embodiment of the present invention includes a case 1 forming the external appearance of the washing machine and a leg assembly 10 combined with the bottom of the case 1.

The case 1 includes a cabinet 2 that has an opened top face and an opened bottom face and forms the side of the washing machine, a top cover 3 for covering the opened top face of the cabinet 2, and a base 5 located on the opened bottom face of the cabinet 2.

The cabinet 2 includes an outer tub 4 for containing water, an inner tub 6 that is disposed in the outer tub 4 and has fabric loaded therein, a driver 8 such as a motor for driving the inner tub 6, a water supply assembly for supplying water to the inside of the outer tub 4, and a drain assembly 20 for draining the water contained in the outer tub 4 after a washing or spin-drying operation is finished.

In addition, the washing machine further includes a detergent supply unit 30 for temporarily storing detergent, which is fitted in the top cover 3. The detergent supply unit 30 is connected to the water supply assembly and provides the detergent with supplied water to the inner tub 6.

The top cover 3 includes a fabric entrance 3*a* through which fabric is put in or out of the inner tub 6 and a door 40 for opening/closing the fabric entrance 3*a*. The door 40 may be partially made of glass such that the inside of the washing machine is seen. The door 40 includes a frame 40*a* and a glass part 40*b* fitted in the frame 40*a*.

Further, a display panel 7 for inputting an instruction for operating the washing machine or displaying an operating state of the washing machine is attached to one side of the top cover 3.

The outer tub 4 is suspended from the top of the inside of the cabinet 2 according to a plurality of suspensions 15. One end of each suspension 15 may be combined with the top of the inside of the cabinet 2 and the other end thereof may be combined with the bottom of the outer tub 4.

A pulsator 9 is disposed on the bottom of the inner tub 6 to generate a rotating stream in water contained in the outer tub 4. The pulsator 9 may be integrated with the inner tub 6 and rotated with the inner tub 6 when the motor rotates. Otherwise, the pulsator 9 may be formed independently of the inner tub 6 and rotated separately from the inner tub 6 when the motor rotates.

A balancer 12 is provided at an upper portion of the inner tub 6 to prevent the inner tub 6 from losing its balance due to eccentricity of fabric. The balancer 12 may be implemented as a liquid balancer filled with a liquid such as salt water.

An outer tub cover 14 for preventing escape of fabric or scattering of water is disposed on the outer tub 4.

The water supply assembly includes an outer hose 11 for guiding water supplied from an external tap to the washing machine, a water supply valve 12 connected to the outer hose 11 to control supply of water, and a water supply hose 13 for connecting the water supply valve 12 and the detergent supply unit 30. A water supply passage is formed by the water supply valve 12 and the water supply hose 13.

The detergent supply unit 30 is disposed on the water supply passage. The detergent supply unit 30 includes a detergent box housing 31 connected with the water supply hose 13, a detergent box 32 detachably set in the detergent box housing 31, and a detergent box cover fixed to the detergent box housing and disposed on the detergent box 32 to spray water.

The detergent box housing 31 is fitted in a detergent box installing part formed at one side of the top cover 3.

The detergent box 32 is combined with the detergent box housing 31 such that a user can take out the detergent box 32 from the detergent box housing 31 to put detergent into the detergent box. The detergent box 32 may slide into/out of the detergent box housing 31 in the forward/backward direction. At least a part of the backside of the detergent box 32 is opened such that the detergent can be provided to the detergent box housing 31 with water through the backside of the detergent box 32 when the water is supplied.

The drain assembly 20 includes a first drain hose 21 connected to a lower portion of the outer tub 4, a drain valve 22 disposed on the first drain hose 21 to control drainage of water, a drain pump housing 24 having a drain pump for pumping water, and a second drain hose 25 connected to the drain pump housing 24 to drain water pumped by the drain pump to the outside of the cabinet 2. A drain motor for driving the drain pump is disposed inside the drain pump housing 24.

The drain assembly 20 may be located between the outer tub 4 and the base 5.

Figure 3:
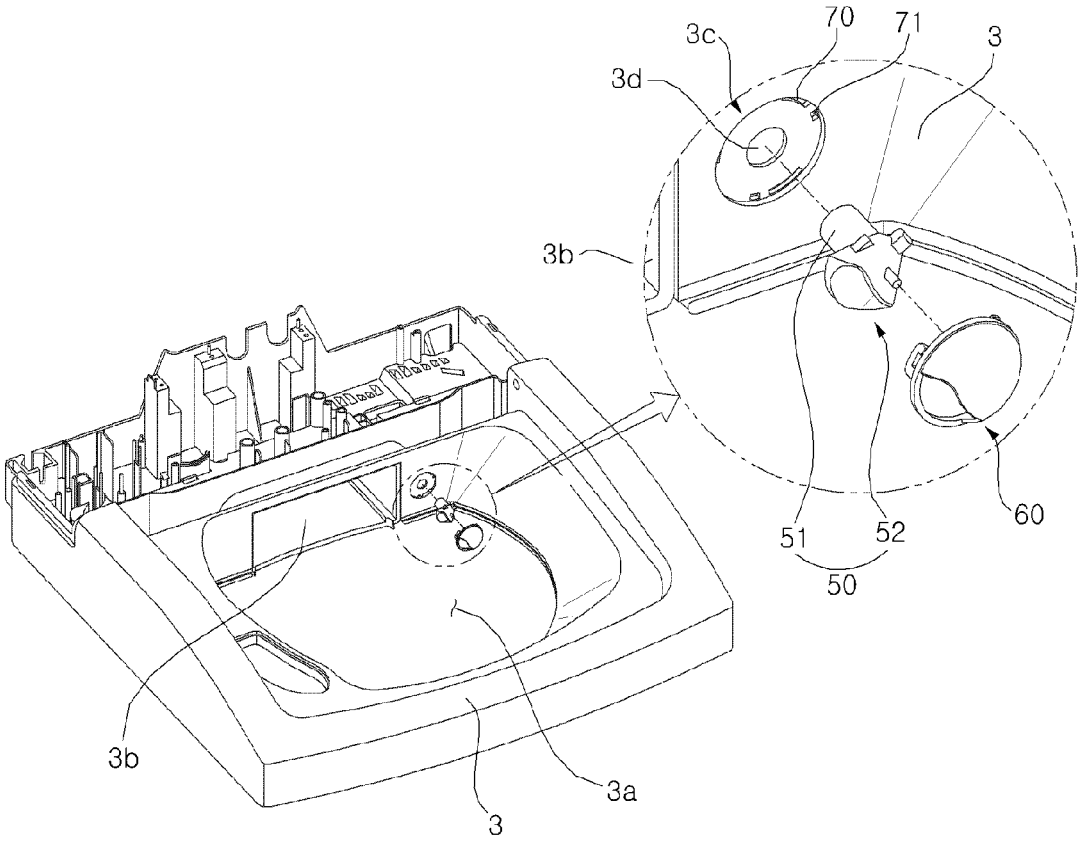
FIG. 3 is a perspective view showing a structure of combination of a top cover, a spray nozzle and a nozzle cap of the fabric treating machine according to the first embodiment of the present invention.
Figure 4:
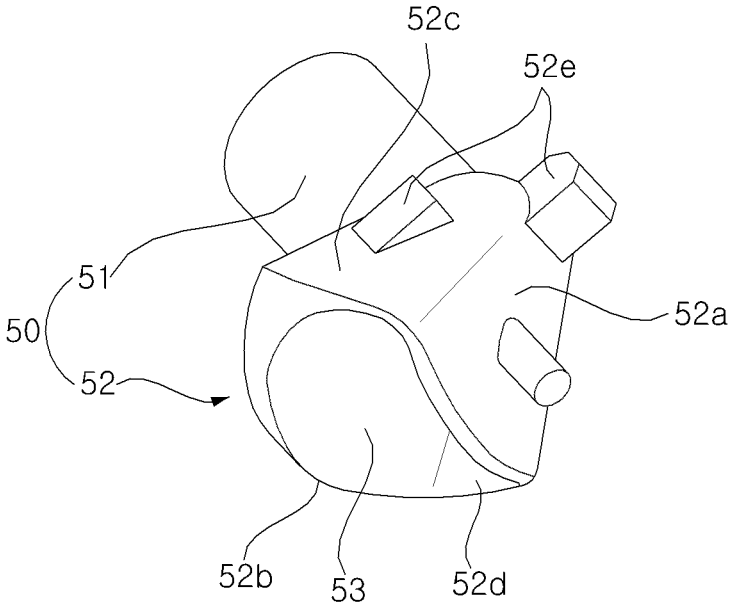
FIG. 4 is an enlarged view of the spray nozzle shown in FIG. 3.
Figure 5:
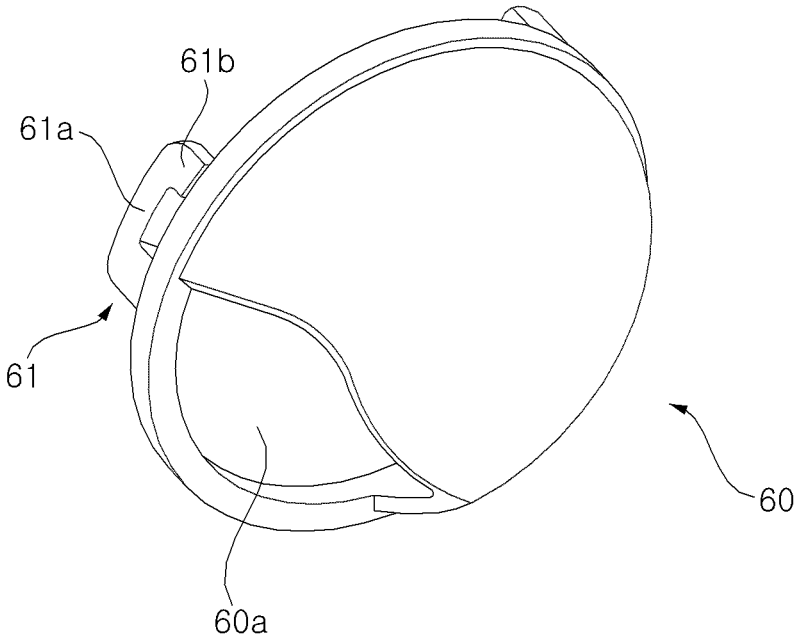
FIG. 5 is an enlarged view of the nozzle cap shown in FIG. 3.
Figure 6:
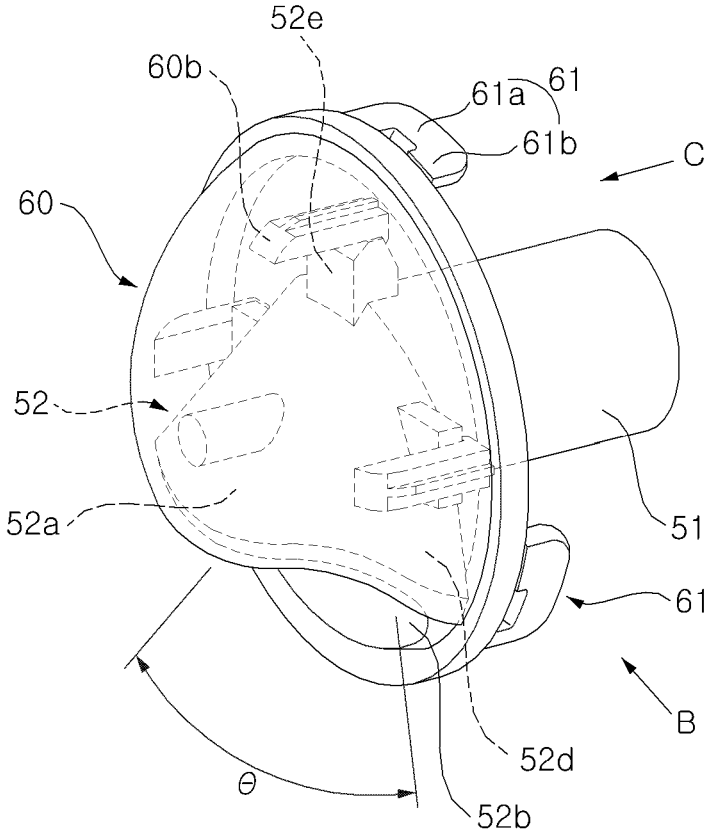
FIG. 6 is a perspective view showing combination of the spray nozzle and the nozzle cap shown in FIG. 3.
Figure 7:
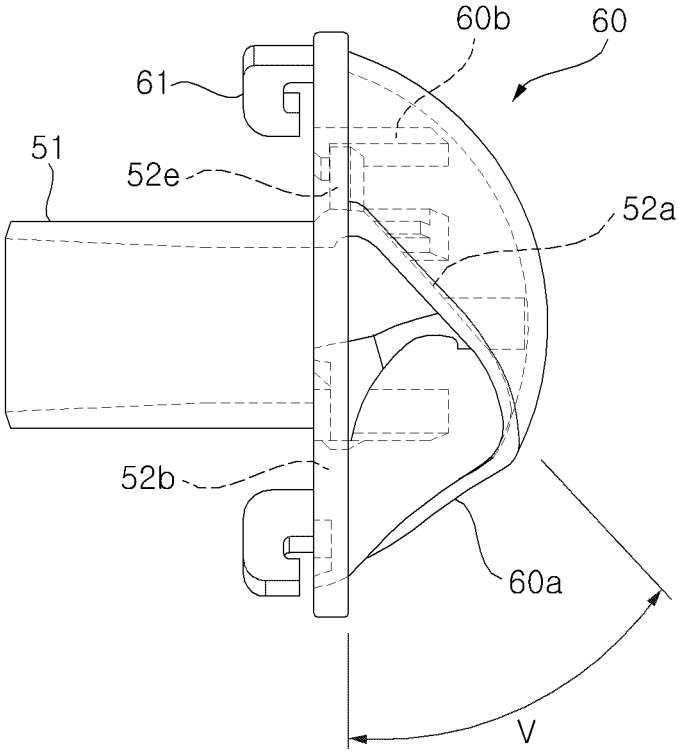
FIG. 7 is a cross-sectional view seen from direction B of FIG. 6.
Figure 8:
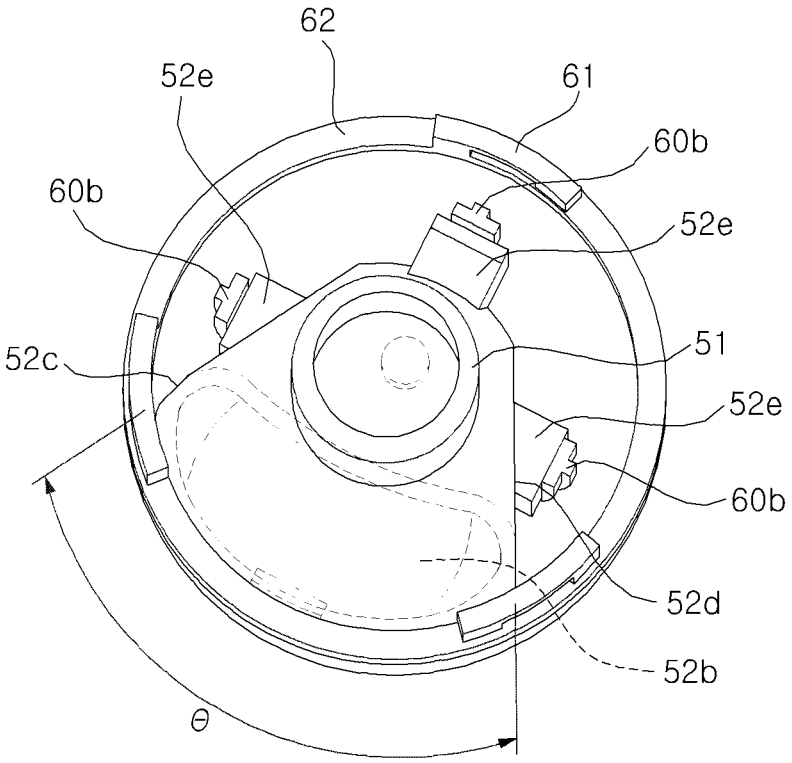
FIG. 8 is a rear view seen from direction C of FIG. 6.

FIG. 3 is a perspective view showing a structure of combination of a top cover, a spray nozzle and a nozzle cap of the washing machine according to the first embodiment of the present invention, FIG. 4 is an enlarged view of the spray nozzle shown in FIG. 3, and FIG. 5 is an enlarged view of the nozzle cap shown in FIG. 3. FIG. 6 is a perspective view showing a state of combination of the spray nozzle and the nozzle cap shown in FIG. 3, FIG. 7 is a cross-sectional view seen from direction B of FIG. 6, and FIG. 8 is a rear view seen from direction C of FIG. 6.

Referring to FIG. 3, the washing machine further includes the spray nozzle 50 for spraying water supplied from the water supply passage to the inside of the inner tub 6 and the spray nozzle combining unit for fitting the spray nozzle 50 in the case 1.

In the current embodiment of the present invention, the spray nozzle combining unit combines the spray nozzle 50 with the top cover 3.

The detergent box installing part 3*b* is formed at one side of the top cover 3, which faces the fabric entrance 3*a*. The detergent box housing 31 is installed in the detergent box installing part 3*b* and the detergent box 32 is set in the detergent box housing 31.

Furthermore, a spray nozzle combining part 3*c* is formed in the top cover 3 to be combined with the spray nozzle 50 according to the spray nozzle combining means.

The spray nozzle combining part 3*c* may be formed at a predetermined distance from the detergent box installing part 3*b* in the horizontal direction. However, the position of the spray nozzle combining part 3*c* is not limited thereto and may be formed at another position in the top cover 3, which faces the fabric entrance 3*c*.

The spray nozzle 50 may be provided with water from the water supply hose 13 or through the detergent box 32. The following description is given under the assumption that the spray nozzle 50 directly receives water from the water supply hose 13.

That is, the spray nozzle 50 is connected to a water supply hose (not shown) for the nozzle, which is branched from the water supply hose 13, and sprays water that has passed through the water supply hose 13 and the water supply hose (not shown) for the nozzle. The water supply hose for the nozzle may include a water supply valve (not shown) for the nozzle for controlling water supplied to the spray nozzle 50.

Furthermore, the water supply hose for the nozzle, which is connected to the spray nozzle 50, may not be branched from the water supply hose 13 and may be disposed separately from the water supply hose 13.

The spray nozzle 50 includes a tube 51 connected with the water supply hose for the nozzle to guide water and a spraying unit 52 that is extended at the end of the tube 51 and sprays water.

The tube 51 is fitted in the spray nozzle combining part 3*c* of the top cover 3. The spray nozzle combining part 3*c* includes a tube insertion hole 3*d* into which the tube 51 is inserted. The tube insertion hole 3*d* corresponds to the shape of the tube 51.

Referring to FIG. 4, the spraying unit 52 includes a top part 52*a* extended from the tube 51 and inclined downward, a bottom part 52*b* that is disposed on the tube 51 and extended in the vertical direction and faces the top part 52*a*, and left and right side parts 52*c* and 52*d* connecting the top part 52*a* and the bottom part 52*b*. The top part 52*a*, the bottom part 52*b* and the left and right side parts 52*c* and 52 may be formed in one body and edges thereof may be rounded.

The top part 52*a* may restricts an upward spray angle of water sprayed through the spraying unit 52 and the left and right side parts 52*c* and 52*d* may restrict a side direction spray angle of the water sprayed through the spraying unit 52.

The top part 52*a* is inclined downward from the tube 51 and the bottom part 52*b* is disposed on the tube 51 and extended in the vertical direction. That is, the distance between the top part 52*a* and the bottom part 52*b* becomes wider in the vertical direction.

Referring to FIGS. 4 and 7, a highest point that water reaches when the water is sprayed may depend on an angle V between the top part 52*a* and the bottom part 52*b*. Hereinafter, the angle V between the top part 52*a* and the bottom part 52*b* is referred to as 'vertical angle'.

Referring to FIGS. 4, 6 and 8, the left side plate 52*c* is inclined to the left from the tube 51 and the right side part 52*d* is inclined to the right from the tube 51. That is, the distance between the left side part 52*c* and the right side part 52*d* becomes wider in the horizontal direction.

A side direction spray angle of water depends on an angle θ between the left side part 52*c* and the right side part 52*c*. Hereinafter, the angle θ between the left side part 52*c* and the right side part 52*d* is referred to as 'spray width angle'.

Furthermore, when the spray nozzle 50 is fitted in the top cover 3, the spray nozzle 50 is disposed such that the direction of washing water is biased to one of left and right sidewalls of the inner tub 6. That is, the spray nozzle 50 is located at a predetermined angle to one of the left and right sidewalls of the inner tub 6. Accordingly, the washing water can soak the sidewall of the inner tub 6 as well as the bottom of the inner tub 6.

Figure 9:
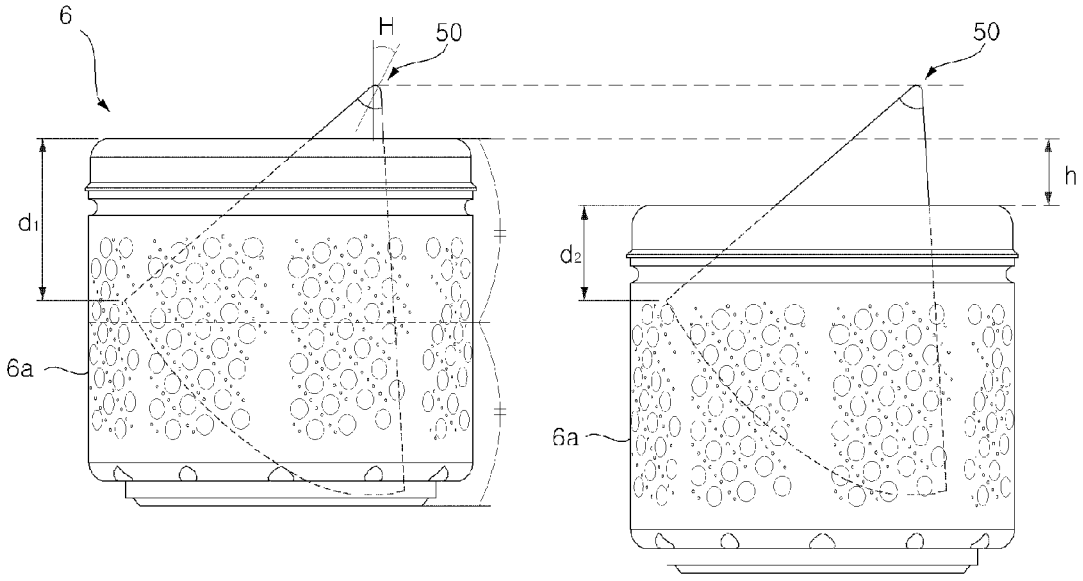
FIG. 9 illustrates a spray range of the spray nozzle according to the first embodiment of the present invention.

FIG. 9 illustrates a spray range of the spray nozzle 50 according to the first embodiment of the present invention. Referring to FIG. 9, it is preferable that a distance d between the highest point on the inner sidewall 6*a* of the inner tub 6 that sprayed water reaches and the top end of the inner tub 6 is larger than a distance d2 (for example, 162 mm) between the highest point on the inner sidewall 6*a* of the inner tub 6 that sprayed water reaches and the top end of the inner tub 6 when full load is applied to the inner tub 6 and smaller than a distance d1 (for example, 200 mm) between the highest point on the inner sidewall 6*a* of the inner tub 6 that sprayed water reaches and the top end of the inner tub 6 when there is no load in the inner tub 6.

If the distance d between the highest point on the inner sidewall 6*a* of the inner tub 6 that sprayed water reaches and the top end of the inner tub 6 falls in the aforementioned range, side spraying from the spray nozzle 50 can be performed even when the inner tub 6 has a minimum load and water sprayed from the spray nozzle 50 can be prevented from overflowing the inner tub 6 even when the inner tub 6 has a maximum load.

As described above, it is important to adjust an angle of a nozzle 53 (shown in FIG. 10) of the spray nozzle 50, which faces the inner sidewall 6*a* of the inner tub 6, in order to allow the highest point on the inner sidewall 6*a* of the inner tub 6 that sprayed water reaches to falls in the aforementioned predetermined spray range.

Figure 10:
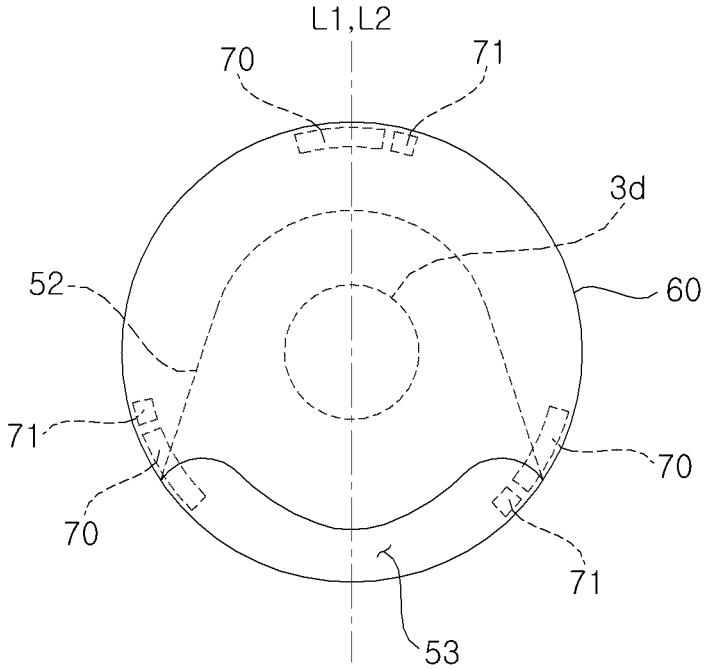
FIG. 10 illustrates a state in which an inserted part of the nozzle cap according to the first embodiment of the present invention is inserted into a slit of the top cover.

Referring to FIGS. 9 and 10, it is required to rotate the spray nozzle 50 at a predetermined angle H from the vertical center line L1 of the tube insertion hole 3*d* of the top cover 3 and fit the rotated spray nozzle 50 in the top cover 3 in order to control the nozzle 53 of the spray nozzle 50 to face the inner sidewall 6*a* of the inner tub 6. Here, the predetermined angle H is referred to as 'side direction spray angle'.

As described above, all the vertical angle V of the spraying unit 52, the spray width angle θ between the left side part 52*c* and the right side part 52*d*, and the side direction spray angle H of the spraying unit 52 are important variables for determining the spray range of the spray nozzle 50.

When water sprayed through the spraying unit 52 is prevented from overflowing the inner tub 6 and the spray range is set such that the sprayed water can sufficiently soak fabric loaded in the inner tub 6, the vertical angle V, the spray width angle θ and the side direction spray angle H can be determined.

The vertical angle V and the spray width angle θ may be reflected when the shape of the spray nozzle 50 is formed.

The side direction spray angle H may be reflected when the spray nozzle 50 is fitted in the top cover 3.

Accordingly, the spray nozzle combining unit according to the first embodiment of the present invention combines the spray nozzle 50 with the top cover 3 such that the spray direction of the spray nozzle 50 falls in the predetermined spray range. That is, the spray nozzle combining unit is required to guide a fitting position of the spray nozzle 50 in consideration of the side direction spray angle H.

The spray nozzle combining unit according to the first embodiment of the present invention includes a nozzle cap 60 covering the spray nozzle 50.

Referring to FIG. 5, the nozzle cap 60 has a hemispherical shape for covering the nozzle 53 of the spray nozzle 50 and includes an opening 60*a* corresponding to the nozzle 53 of the spray unit 52.

The spray nozzle 50 may be press-fitted in the nozzle cap 60.

Referring to FIG. 4, a plurality of press-fitted protrusions 52*e* are formed around the nozzle 52 of the spray nozzle 50. The edges of the press-fitted protrusions 52*e* are tapered such that the spray nozzle 50 can be easily press-fitted in the nozzle cap 60.

Referring to FIG. 6, guide ribs 60*b* corresponding to the press-fitted protrusions 52*e* are formed in the nozzle cap 60 to form press-fit grooves in which the press-fitted protrusions 52*e* are fitted.

Furthermore, the nozzle cap 60 is fitted in the top cover 3, rotated at a predetermined angle, and then fixed thereto. When the nozzle cap 60 is rotated, the spray nozzle 50 is rotated with the nozzle cap 60. The nozzle cap 60 is rotated clockwise at a predetermined angle since the spraying unit 52 of the spray nozzle 50 is required to face the fabric entrance 3*a*.

Referring to FIG. 3, a slit 70 is formed in the spray nozzle combining part 3*c* of the top cover 3 and a fixing hole 71 is formed at a predetermined distance from the slit 70.

Referring to FIGS. 5 and 6, a combining protrusion 61 is formed on the backside of the nozzle cap 60. The combining protrusion 61 is inserted into the slit 70, rotated along the slit 71 in a sliding manner, and then fixed by the fixing hole 71.

There may be a plurality of combining protrusions 61 formed around the edge of the backside of the nozzle cap 60 at predetermined intervals. In the current embodiment of the present invention, three combining protrusions 61 are formed at an interval of 120°.

The combining protrusion 61 includes an inserted part 61*a* projected backward from the nozzle cap 60 and inserted into the slit 70 and a fixed part 61*b* bent forward from the inserted part 61*a* and fixed by the fixing hole 71.

When the inserted part 61*a* of the nozzle cap 60 is inserted into the slit 70, and then the nozzle cap 60 is rotated at a predetermined angle, the fixed part 61*b* is fixed in the fixing hole 71 to fix the nozzle cap 60.

The direction of the nozzle 53 of the spray nozzle 50 depends on the rotating angle of the nozzle cap 60. That is, the spray direction of the spray nozzle 50 can be adjusted to falls in a predetermined spray range by controlling the rotating angle of the nozzle cap 60.

The predetermined spray range includes a range that restricts a highest point on the inner sidewall of the inner tub 6 that water sprayed through the spray nozzle 60 reaches. The highest point on the inner sidewall of the inner tub 6 that the sprayed water reaches is restricted in order to prevent the water sprayed through the spray nozzle 60 from overflowing the inner tub 6 and sufficiently soak fabric loaded in the inner tub 6.

Figure 11:
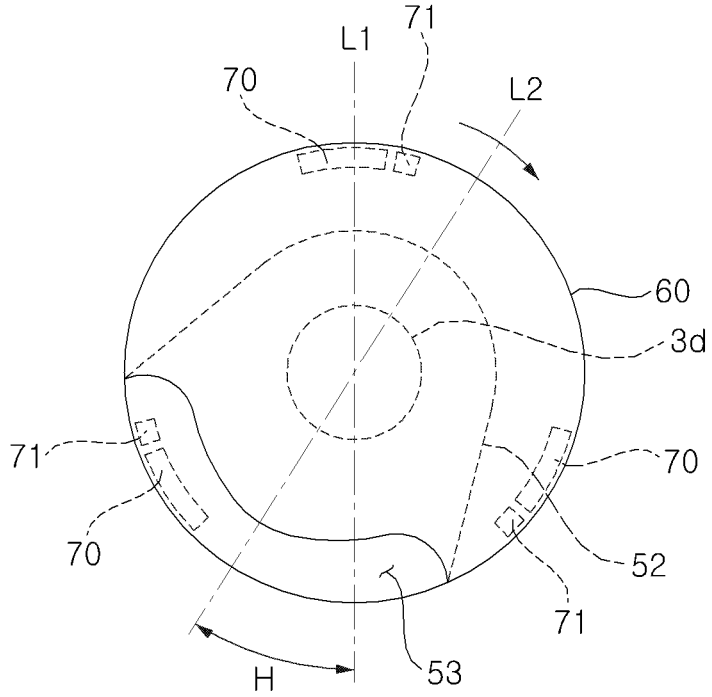
FIG. 11 illustrates a state in which the nozzle cap according to the first embodiment of the present invention is rotated at a predetermined angle.

FIG. 10 illustrates a state in which the inserted part 61*a* of the nozzle cap 60 according to the first embodiment of the present invention is inserted into the slit 70 of the top cover 3 and FIG. 11 illustrates a state in which the nozzle cap 60 according to the first embodiment of the present invention is rotated at a predetermined angle.

Referring to FIGS. 10 and 11, when the inserted part 61*a* of the nozzle cap 60 is inserted into the slit 70, the vertical center line L1 of the tube insertion hole 3*d* corresponds to the vertical center line L2 of the spraying unit 52 of the spray nozzle 50.

If the nozzle cap 60 is rotated at a predetermined angle such that the inserted part 61*s* of the nozzle cap 60 is rotated clockwise along the slit 70 at a predetermined angle, the vertical center line L2 of the spraying unit 52 is deviated from the vertical center line L1 of the tube insertion hole 3*d* at a predetermine angle H. The rotating angle H of the nozzle cap 60 corresponds to the angle H between the vertical center line L1 of the tube insertion hole 3*d* and the vertical center line L2 of the spraying unit 52.

The highest point on the inner sidewall of the inner tub 6 that water sprayed through the spray nozzle 50 reaches depends on the angle H between the vertical center line L1 of the tube insertion hole 3*d* and the vertical center line L2 of the spraying unit 52.

That is, the highest point on the inner sidewall of the inner tub 6 that the water sprayed through the spray nozzle 50 reaches can vary with the rotating angle H of the nozzle cap 60. The rotating angle H of the nozzle cap 60 may be determined according to the length of the slit 70 and positions of the slit 70 and the fixing hole 71.

A method of combining the spray nozzle, constructed as above, according to the first embodiment of the present invention with the top cover will now be explained.

The spray nozzle 50 is press-fitted in the nozzle cap 60 and integrated with the nozzle cap 60. After the spray nozzle 50 and the nozzle cap 60 are integrated with each other, the tube 51 of the spray nozzle 50 may be inserted into the tube insertion hole 3*d*. Otherwise, the nozzle cap 60 may be combined with the spray nozzle 50 when the tube 51 of the spray nozzle 50 has been inserted into the tube insertion hole 3*d*.

Then, the inserted part 61*a* of the combining protrusion 61 of the nozzle cap 60 is inserted into the slit 70, which is shown in FIG. 10.

Subsequently, the nozzle cap 60 is rotated clockwise at a predetermined angle. Then, the inserted part 61*a* is rotated along the slit 70. If the nozzle cap 60 is pulled forward after rotated at the predetermined angle, the fixed part 61*b* of the combining protrusion 61 of the nozzle cap 60 is fixed in the fixing hole 71. Accordingly, the nozzle cap 60 is fixed to the top cover 3.

When the nozzle cap 60 is rotated at the predetermined angle and fixed, the nozzle 53 of the spray nozzle 50 faces the inner sidewall 6*a* of the inner tub 6 as well as the bottom of the inner tub 6. Accordingly, water is sprayed to not only the bottom of the inner tub 6 but also the inner sidewall of the inner tub 6 through the spray nozzle 50.

Furthermore, the slit 70 and the fixing hole 71 guide the combining position and rotating angle of the nozzle cap 60, and thus the spray direction of the spray nozzle 50 can be set in a predetermined spray range.

Figure 12:
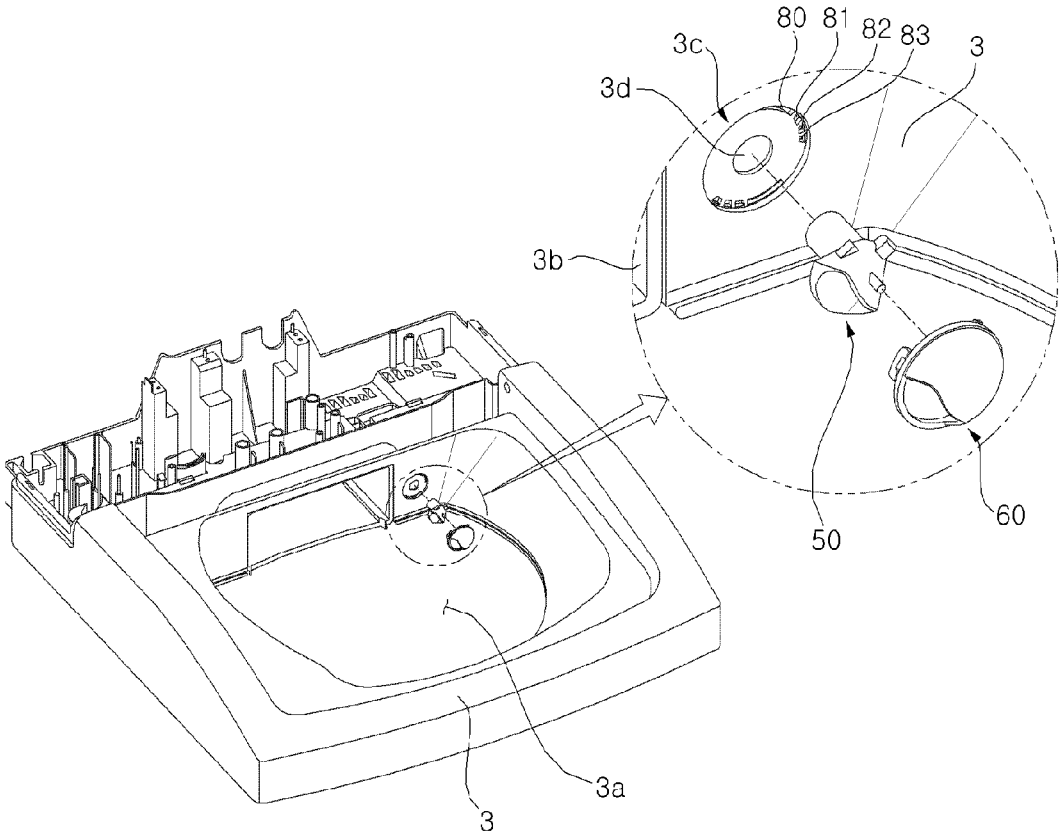
FIG. 12 is a perspective view of a structure of combination of a top cover, a spray nozzle and a nozzle cap of a fabric treating machine according to a second embodiment of the present invention.

FIG. 12 is a perspective view of a structure of combination of a top cover, a spray nozzle and a nozzle cap of a washing machine according to a second embodiment of the present invention.

Referring to FIG. 12, a slit 80 is formed in the spray nozzle combining part of the top cover 3 and fixing holes 81, 82 and 83 are formed at a predetermined distance from the slit 80. The fixing holes 81, 82 and 83 are arranged at predetermined intervals. The Configuration and action of the washing machine according to the second embodiment of the present invention are identical or similar to those of the washing machine according to the first embodiment of the present invention except that the fixing holes 81, 82 and 83 selectively hold the combining protrusion 61 according to the rotating angle of the nozzle cap 60 so that detailed explanations thereof are omitted.

The rotating angle of the nozzle cap 60 can be adjusted according to the number of fixing holes 81, 82 and 83. The current embodiment of the present invention is described under the assumption that there are first, second and third fixing holes 81, 82 and 83. The first, second and third fixing holes 81, 82 and 83 are sequentially arranged at predetermined distances from the slit 80.

In a region having average water pressure, the nozzle cap 60 is rotated at a set angle such that the combining protrusion 61 of the nozzle cap 60 is fixed to the second fixing hole 82.

In a region having water pressure lower than the average water pressure, the nozzle cap 60 is rotated at an angle larger than the set angle such that the combining protrusion 61 of the nozzle cap 60 is fixed to the third fixing hole 83. Accordingly, water sprayed through the spray nozzle 50 can be prevented from being sprayed only downward when water pressure is lower than the average water pressure.

In a region having water pressure higher than the average water pressure, the nozzle cap 60 is rotated at an angle smaller than the set angle such that the combining protrusion 61 of the nozzle cap 60 is fixed to the first fixing hole 81. Accordingly, water sprayed through the spray nozzle 50 can be prevented from overflowing when water pressure is higher than the average water pressure.

Figure 13:
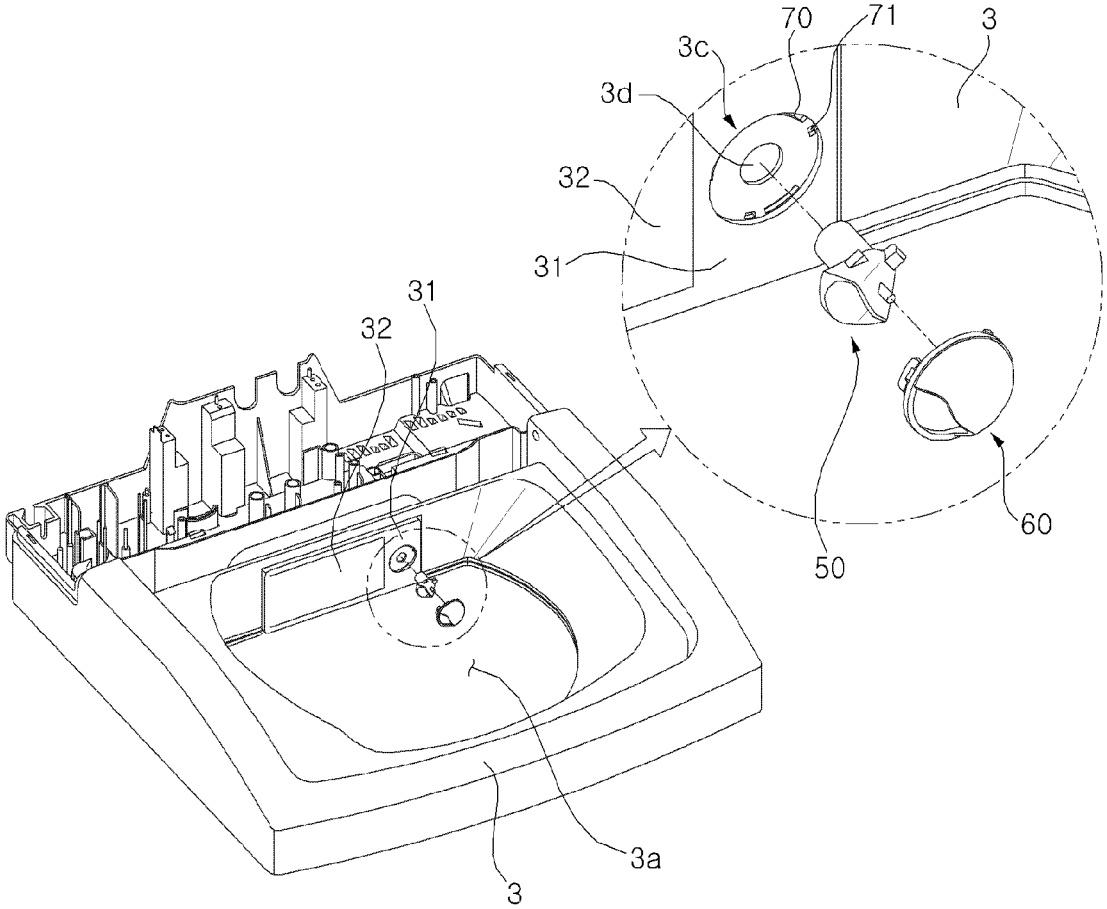
FIG. 13 is a perspective view of a structure of combination of a detergent supply unit and a spray nozzle of a fabric treating machine according to a third embodiment of the present invention.

FIG. 13 is a perspective view of a structure of combination of a detergent supply unit and a spray nozzle of a washing machine according to a third embodiment of the present invention.

Referring to FIG. 13, a spray nozzle combining unit according to the third embodiment of the present invention corresponds to the nozzle cap 60 covering the spray nozzle 50. The configuration and action of the washing machine according to the third embodiment of the present invention are identical or similar to those of the washing machine according to the first embodiment of the present invention except that the nozzle cap 60 is fitted in the detergent box housing 31 corresponding to the detergent supply unit so that detailed explanations thereof are omitted.

The nozzle cap 60 may be combined with the front side of the detergent box housing 31.

Figure 14:
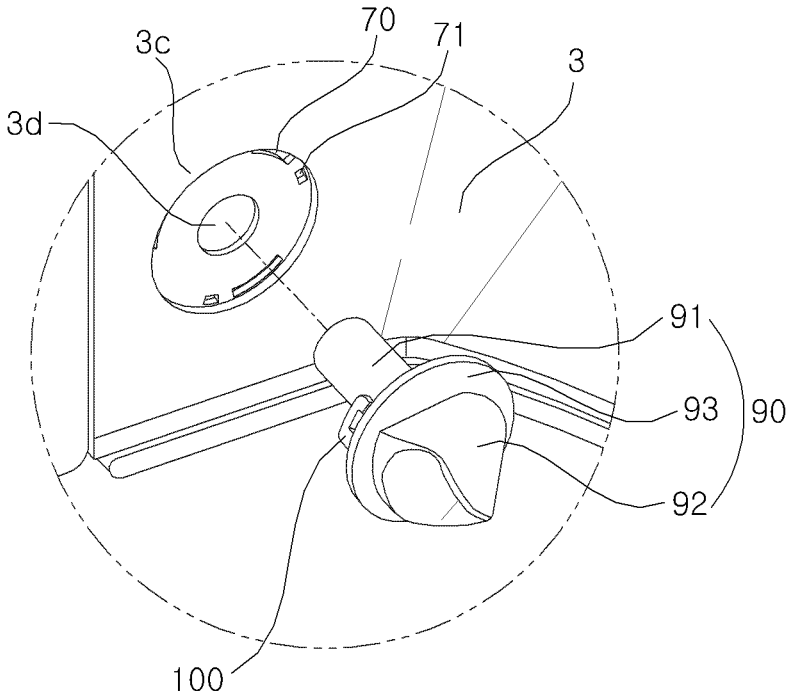
FIG. 14 is a perspective view of a structure of direct combination of a top cover and a spray nozzle of a fabric treating machine according to a fourth embodiment of the present invention.

FIG. 14 is a perspective view of a structure of direct combination of a top cover and a spray nozzle of a washing machine according to a fourth embodiment of the present invention.

Referring to FIG. 14, the configuration and action of the washing machine according to the fourth embodiment of the present invention are identical or similar to those of the washing machine according to the first embodiment of the present invention except that a spray nozzle combining unit according to the fourth embodiment of the present invention includes a combining protrusion 100 projected from a spray nozzle 90 and fitted in the top cover 3 rotatably at a predetermined angle so that detailed explanations thereof are omitted.

The spray nozzle 90 includes a tube 91 and a spraying unit 92. A disc-shaped rib 93 is formed on the tub 91. The combining protrusion 100 is projected backward from the backside of the rib 93.

The combining protrusion 100 is inserted into the slit 70 formed in the top cover 3 and then fixed to the fixing hole 71.

Accordingly, an additional nozzle cap is not needed and the combining protrusion 100 is integrated with the spray nozzle 90, and thus the structure of combination of the top cover and the spray nozzle can be simplified.

Figure 15:
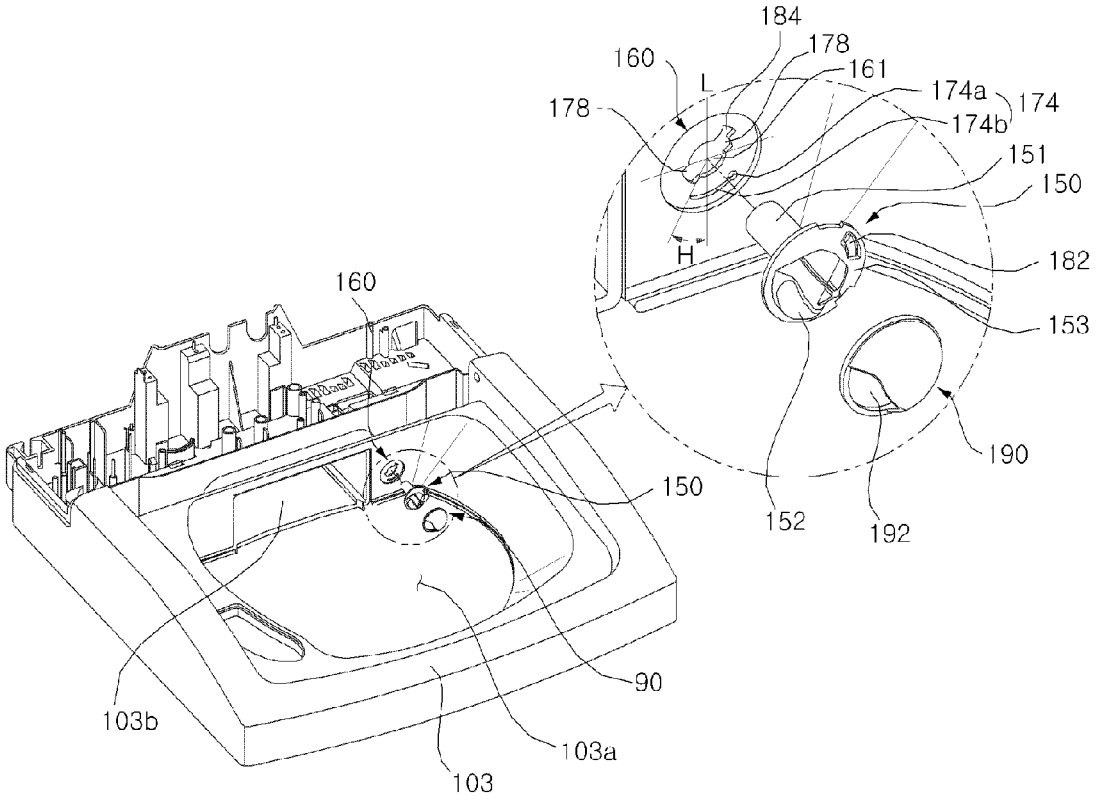
FIG. 15 is a perspective view of a structure of combination of a top cover, a spray nozzle and a nozzle cap of a fabric treating machine according to a fifth embodiment of the present invention.
Figure 16:
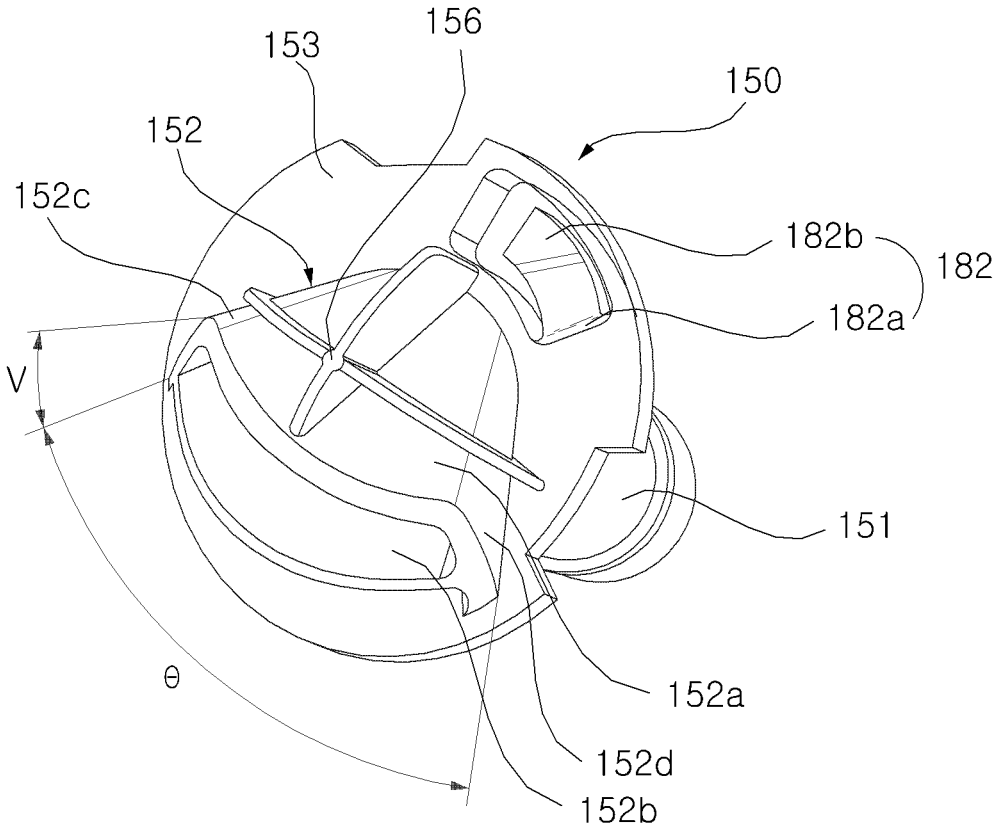
FIG. 16 is an enlarged view of the spray nozzle shown in FIG. 15.
Figure 17:
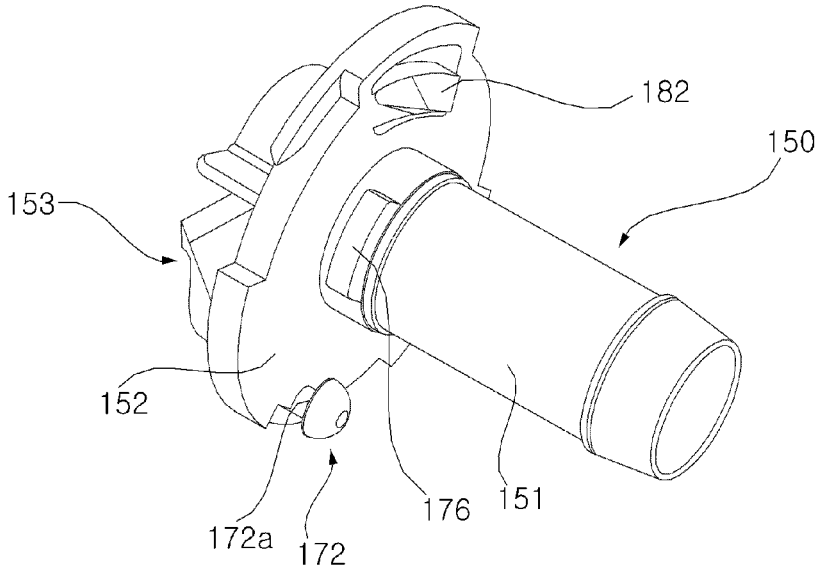
FIG. 17 is a rear perspective view of the spray nozzle shown in FIG. 16.
Figure 18:
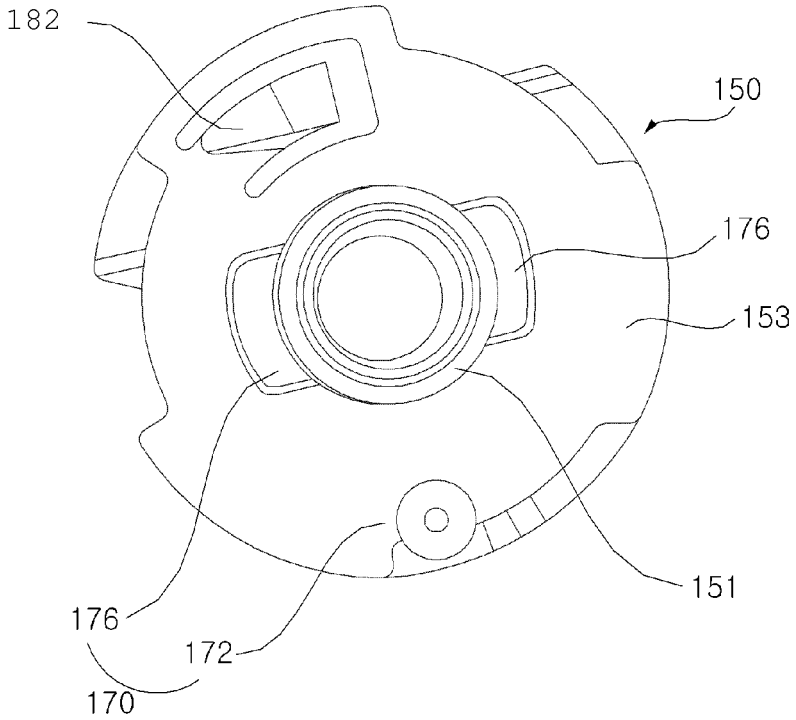
FIG. 18 is a rear view of the spray nozzle shown in FIG. 16.
Figure 19:
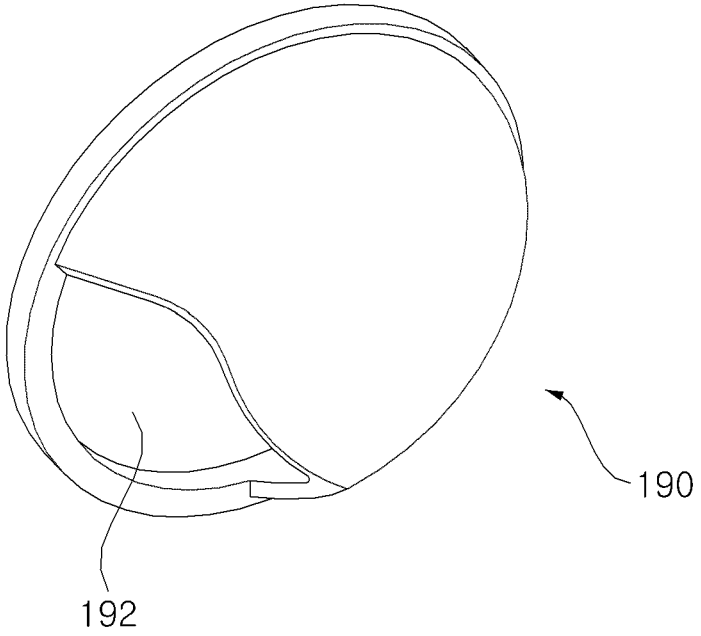
FIG. 19 is an enlarged view of the nozzle cap shown in FIG. 15.

FIG. 15 is a perspective view of a structure of combination of a top cover 103, a spray nozzle 150 and a nozzle cap of a washing machine according to a fifth embodiment of the present invention and FIG. 16 is an enlarged view of the spray nozzle 150 shown in FIG. 15. FIG. 17 is a rear perspective view of the spray nozzle shown in FIG. 16, FIG. 18 is a rear view of the spray nozzle 150 shown in FIG. 16 and FIG. 19 is an enlarged view of the nozzle cap shown in FIG. 15.

Referring to FIGS. 15 through 19, the washing machine according to the fifth embodiment of the present invention includes the spray nozzle 150 for spraying water supplied from a water supply passage into the inner tub 6 and spray nozzle combining units 170 and 180 for combining the spray nozzle 150 with the top cover 103. The spray nozzle combining units 170 and 180 include a first combining unit 170 for guiding the spray nozzle 150 to a fitting position and preventing the spray nozzle 150 from moving forward and backward after fitted and a second combining unit 180 fixed in a rotating direction of the spray nozzle 150 after the spray nozzle 150 is rotated at a predetermined angle to restrict the rotating angle of the spray nozzle 150 and prevent the spray nozzle 150 from moving in the rotating direction. Configurations and actions of components of the washing machine other than the spray nozzle 150 and the spray nozzle combining units 170 and 180 according to the fifth embodiment of the present invention are identical to those of the washing machine according to the first embodiment so that detailed explanations thereof are omitted.

The a spray nozzle combining part 160 is formed in the top cover 103 such that the spray nozzle 150 is fitted in the spray nozzle combining part 160 by the spray nozzle combining units 170 and 180.

The spray nozzle combining part 160 may be formed at a predetermined distance from a detergent box installing part 103*b* in parallel with the detergent box installing part 103*b*. However, the position of the spray nozzle combining part 160 is not limited thereto and the spray nozzle combining part 160 may be formed in a portion of the top cover 103, which faces a fabric entrance 103*a*.

The spray nozzle 150 includes a tube 151 connected with a water supply hose (not shown) for the nozzle to guide water, a spraying unit 152 extended at the end of the tube 151 to spray water and a reinforcing plate 153 extended in the radius direction between the tube 151 and the spraying unit 152 to reinforce the strength of combination of the top cover 103 and the spray nozzle 150.

The tube 151 is fitted in the spray nozzle combining part 160 of the top cover 103.

The spray nozzle combining part 160 includes a tube insertion hole 161 formed at the center thereof, into which the tube 151 is inserted. The tube insertion hole 161 corresponds to the shape of the tube 151.

Referring to FIGS. 16 and 17, the spraying unit 152 includes a top part 152*a* disposed on the tube 151 and inclined downward, a bottom part 152*b* that is extended downward from the tube 151 and faces the top part 152*a*, and left and right side parts 152*c* and 152*d* connecting the top part 152*a* and the bottom part 152*b*. The top part 152*a*, the bottom part 152*b* and the left and right side parts 152*c* and 152*d* may be formed in one body and the edges thereof may be rounded.

The top part 152*a* may restrict an upward spray angle of water sprayed through the spraying unit 152. The left and right side parts 152*c* and 152*d* may restrict a side direction spray angle of water sprayed through the spraying unit 152.

The top part 152*a* is inclined downward from the tube 151 and the top part 152*a* and the bottom part 152*b* make an angle V in the vertical direction. The highest spray point of water may depend on the angle V between the top part 152*a* and the bottom part 152*b*. Hereinafter, the angle V is referred to as 'up and down spray angle'.

The left side part 152*c* is inclined to the left from the tube 151 and the right side part 152*d* is inclined to the right from the tube 151. That is, the left side part 152*c* and the right side part 152*d* make an angle θ in the horizontal direction. The side direction spray angle of water depends on the angle θ between the left side part 152*c* and the right side part 152*d*. The angle θ is referred to as 'spray width angle' hereinafter.

The spray nozzle 150 is fitted in the top cover 103 in such a manner that the spray nozzle 150 is rotated at a predetermined angle to bias the direction of washing water to one of the left and right sides of the inner sidewall of the inner tub 6. Accordingly, the washing water can soak the inner sidewall of the inner tub 6 as well as the bottom of the inner tub 6.

Figure 22:
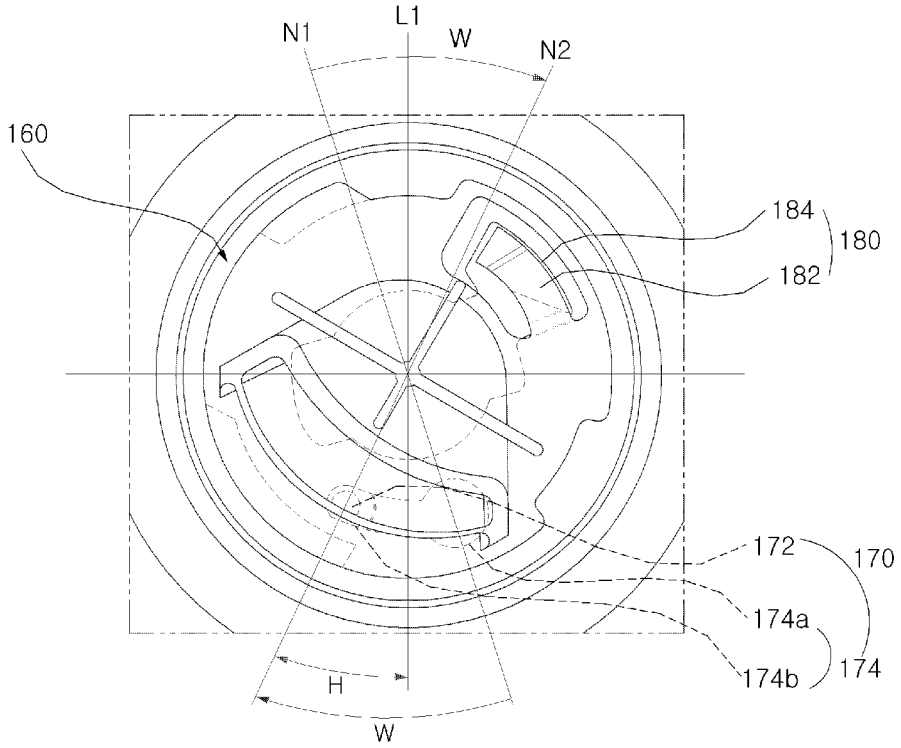
FIG. 22 illustrates a state in which the spray nozzle shown in FIG. 20 has been rotated at a predetermined angle and fitted in the top cover.

Referring to FIG. 22 which will be explained later, the spray nozzle 150 is rotated at a predetermined angle H from the vertical center line L1 of the tube insertion hole 151 of the top cover 103. Hereinafter, the angle H is referred to as 'side direction spray angle'.

It is required to design the shape of the spraying unit 152 of the spray nozzle 150 such that water sprayed through the spraying unit 152 is prevented from overflowing the inner tub 6 and the spray nozzle 150 has a predetermined spray range capable of sufficiently soaking fabric loaded in the inner tub 6.

To allow the spray nozzle 150 to have the aforementioned predetermined spray range, the up and down spray angle V of the spraying unit 152, the spray width angle θ between the left side part 152*c* and the right side part 152*d* and the side direction spray angle H of the spraying unit 152 become important variables.

If the predetermined spray range is set, the up and down spray angle V, the spray width angle θ and the side direction spray angle H for satisfying the predetermined spray range can be determined.

The up and down spray angle V and the spray width angle θ are reflected when the shape of the spray nozzle 150 is formed.

The side direction spray angle H is reflected when the spray nozzle 150 is fitted in the top cover 103.

The washing machine includes the spray nozzle combining units 170 and 180 which combine the spray nozzle 150 with the top cover 103 such that the spray range of the spray nozzle 150 falls in a predetermined spray range while guiding the fitting position of the spray nozzle 150 in consideration of the side direction spray angle H.

The spray nozzle combining units 170 and 180 may be disposed in at least one of the spray nozzle 150 and the top cover 103 and combined with the other.

The spray nozzle combining units includes a first combining unit 170 and a second combining unit 180. The first combining unit 170 guides the spray nozzle 150 to the fitting position of the spray nozzle 150 and prevents the spray nozzle 150 from moving forward and backward after fitted. The second combining unit 180 is fixed in a rotating direction of the spray nozzle 150 after the spray nozzle 150 is rotated at a predetermined angle to restrict the rotating angle of the spray nozzle 150 and prevent the spray nozzle 150 from moving in the rotating direction.

The first combining unit 170 is disposed in at least one of the spray nozzle 150 and the top cover 103 and fitted in the other when the spray nozzle 150 is combined with the top cover 103 to guide the spray nozzle to the fitting position thereof. When the spray nozzle 150 is rotated at a predetermine angle, the first combining unit 170 is fixed in the forward/backward direction.

The first combining unit 170 includes a rear protrusion 171 formed on the spray nozzle 150 and protruded backward toward the top cover 103 and a rear protrusion combining hole 174 that is formed in the top cover 103 and has an arch shape. The rear protrusion 172 is inserted into the rear protrusion combining hole 174 and rotated at a predetermined angle.

The current embodiment of the present invention is described under the assumption that the rear protrusion 172 is formed on the spray nozzle 150 and the rear protrusion combining hole 174 is formed in the top cover 103. However, the rear protrusion 172 may be formed on the top cover 103 and the rear protrusion combining hole 174 may be formed in the spray nozzle 150.

The rear protrusion 172 may be formed on the backside of the reinforcing plate 153 of the spray nozzle 150.

Referring to FIG. 15, the rear protrusion combining hole 174 includes an insertion part 174*a* into which the rear protrusion 172 is inserted and a rotating part 174*b* extended in the form of an arch from the insertion part 174*a* to the rotating direction of the spray nozzle 150.

The rear protrusion 172 may have a shape inserted into the insertion part 174*a* and fixed to the rotating part 174*b*.

The rear protrusion 172 may have a retention projection 172*a* formed at the end thereof. The retention projection 172*a* is smaller than the insertion part 174*a* and larger than the rotating part 174*b*, and thus the retention projection 172*a* is held by the rotating part 174*b*.

The current embodiment of the present invention is described under the assumption that the rear protrusion 172 has a cylindrical form and the retention projection 172*a* has a hemispherical form that is extended from the cylindrical part and has a rounded end. Since the retention projection 172*a* has the hemispherical form, the retention projection 172*a* can be easily inserted into the insertion part 174*a*. However, the shape of the rear protrusion 172 is not limited to the cylindrical form and the cross section of the rear protrusion 172 may have a hook shape.

Referring to FIGS. 15 through 18, the first combining unit 170 includes a radius protrusion 176 protruded from the tube 151 in the radius direction of the tube 151 and a radius hole 178 that is formed in the top cover 103 and corresponds to the shape of the radius protrusion 176.

In the current embodiment of the present invention, two radius protrusions 176 are formed at an interval of 180°.

The second combining unit 180 includes an elastic protrusion 182 that is formed on the spray nozzle 150 and has elasticity in the forward/backward direction and an elastic protrusion combining hole 184 formed in the top cover 103. The elastic protrusion 182 is inserted into the elastic protrusion combining hole 184 after the spray nozzle 150 is rotated at a predetermined angle.

The elastic protrusion 182 is formed by cutting a part of the reinforcing plate 153 of the spray nozzle 150.

One face of the elastic protrusion 182 is connected to the reinforcing plate 153 to form a connecting part 182*a* and three faces thereof are cut to form an elastic part 182*b* having elasticity in the forward/backward direction.

The end of the elastic protrusion 182 is protruded backward from the reinforcing plate 153.

The cross section of the elastic protrusion 182 decreases as the spray nozzle 150 is rotated, that is, the elastic protrusion 182 is inserted into the elastic protrusion combining hole 184. The elastic protrusion 182 has an inclined rear face, and thus the elastic protrusion 182 is easily inserted into the elastic protrusion combining hole 184.

The elastic protrusion combining hole 184 has an arch shape such that the elastic protrusion 182 is inserted into the elastic protrusion combining hole 184 and fixed in the rotating direction of the spray nozzle 150 after the spray nozzle 150 is rotated at a predetermined angle.

Furthermore, the washing machine includes the nozzle cap 190 covering the front of the spray nozzle 150 to form the external appearance of the spray nozzle 150.

A press-fit protrusion 156 is formed on the front face of the spray nozzle 150 such that the spray nozzle 150 is press-fitted in the nozzle cap 190. The press-fit protrusion 156 may have a cross form.

The nozzle cap 190 has an opening 192 formed at a lower portion thereof. The opening 192 corresponds to the nozzle of the spray nozzle 150.

Figure 20:
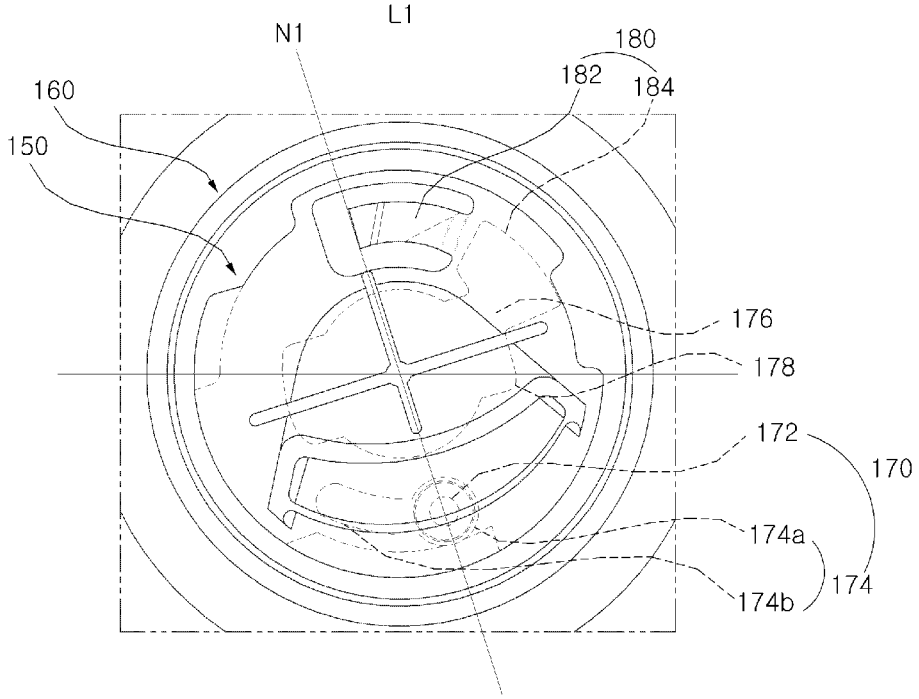
FIG. 20 illustrates an initial assembling state of the top cover and spray nozzle according to the fifth embodiment of the present invention.
Figure 21:
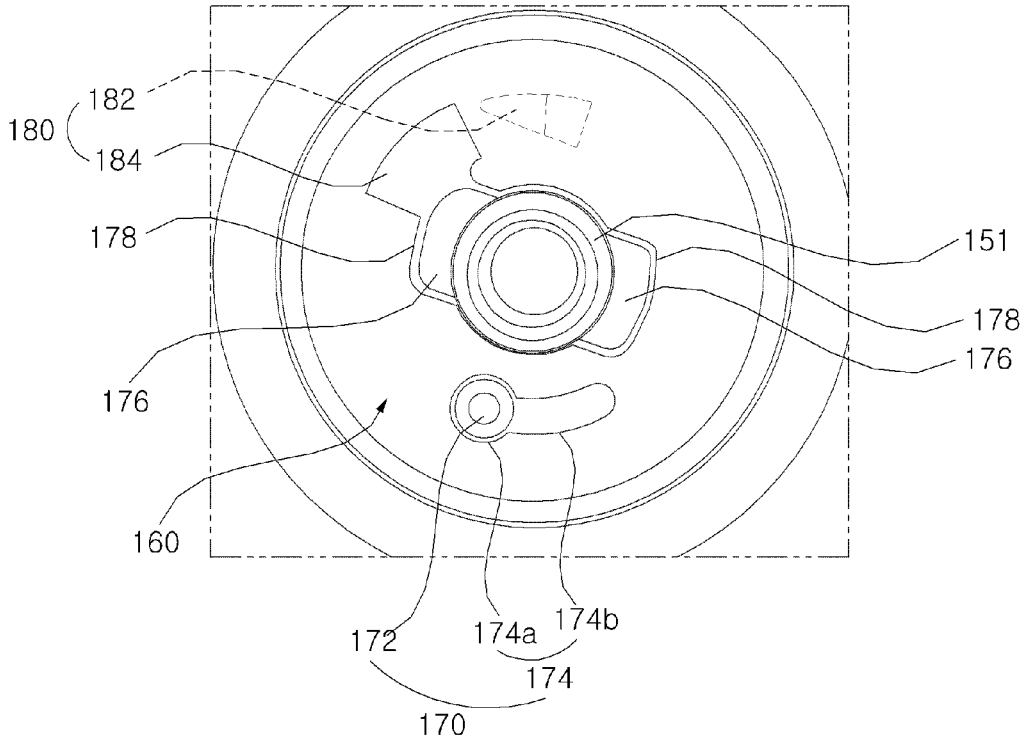
FIG. 21 is a rear view of the top cover and the spray nozzle shown in FIG. 20.

FIG. 20 illustrates an initial assembling state of the top cover and spray nozzle according to the fifth embodiment of the present invention and FIG. 21 is a rear view of the top cover and the spray nozzle shown in FIG. 20.

Referring to FIGS. 20 and 21, when the spray nozzle 150 is fitted in the spray nozzle combining part 160 of the top cover 103, the rear protrusion 172 is inserted into the insertion part 174*a* of the rear protrusion combining hole 174 and the radius protrusion 176 is inserted into the radius protrusion combining hole 178. This state in which the rear protrusion 172 is inserted into the insertion part 174*a* of the rear protrusion combining hole 174 and the radius protrusion 176 is inserted into the radius protrusion combining hole 178 corresponds to an initial fitting position N1 of the spray nozzle 150.

The initial fitting position N1 of the spray nozzle 150 is a position rotated counter clockwise at a predetermined angle from the vertical center line L1 of the tube insertion hole 151 of the top cover 103.

When the spray nozzle 150 is in the initial fitting position N1, the elastic protrusion 182 comes into contact with the front face of the spray nozzle combining part 160. Although the elastic protrusion 182 is projected backward in its initial state, the elastic protrusion 182 is pressed forward by the front face of the spray nozzle combining part 160 when the elastic protrusion comes into contact with the front face of the spray nozzle combining part 160.

Figure 23:
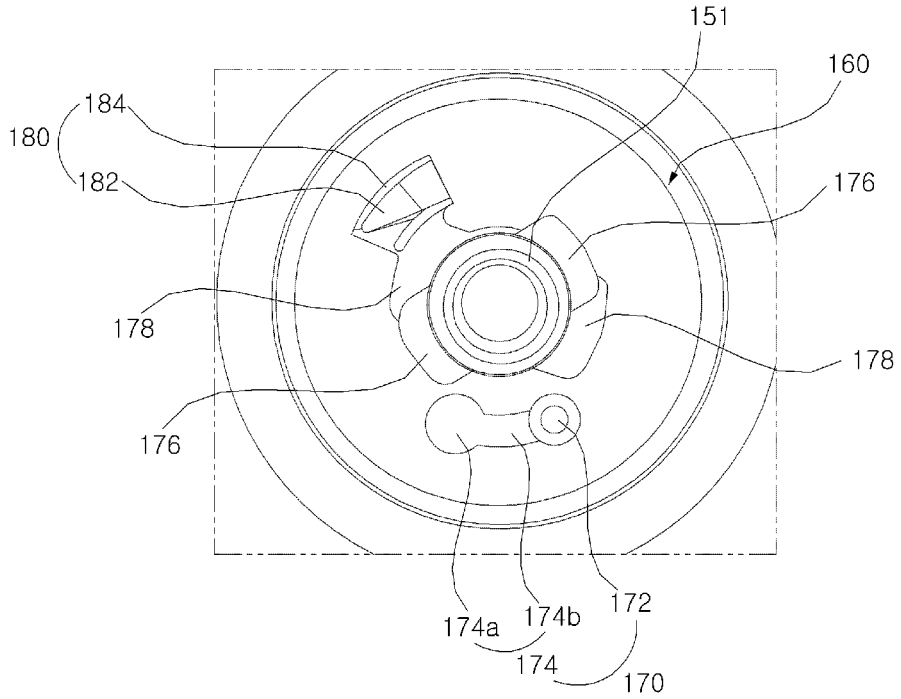
FIG. 23 is a rear view of the top cover and the spray nozzle shown in FIG. 22.
Figure 24:
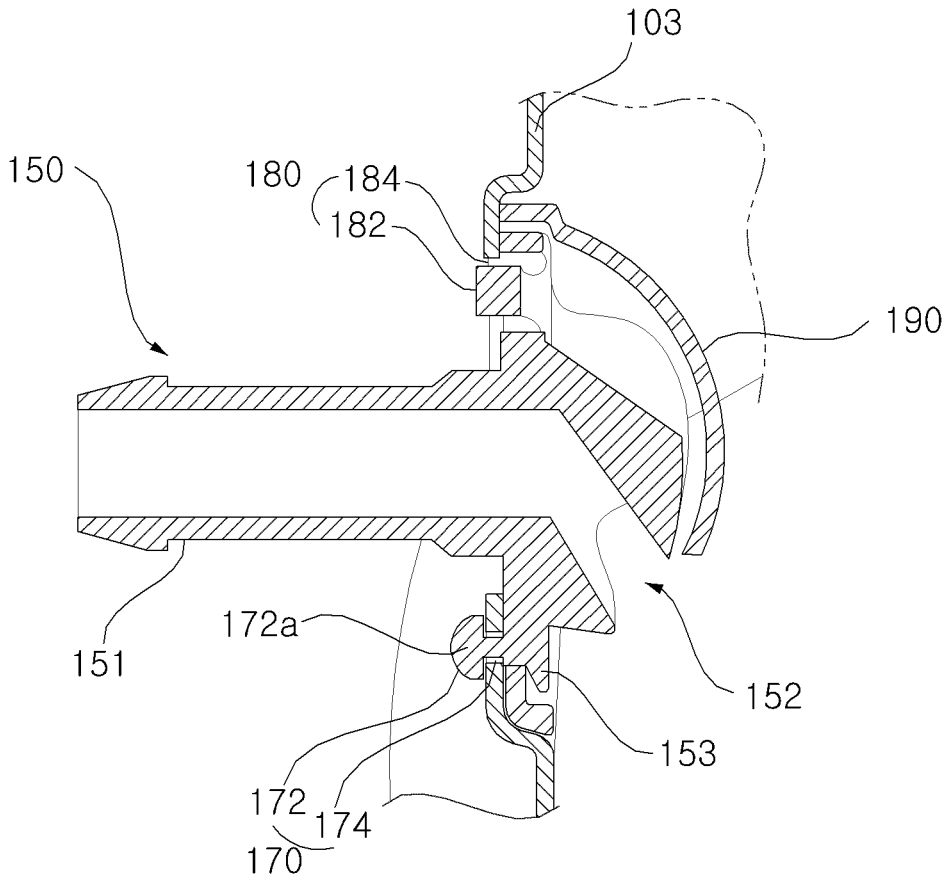
FIG. 24 is a cross-sectional view showing combination of the spray nozzle and the top cover according to the fifth embodiment of the present invention.

FIG. 22 illustrates a state in which the spray nozzle shown in FIG. 20 is rotated at a predetermined angle and fitted in the top cover, FIG. 23 is a rear view of the top cover and the spray nozzle shown in FIG. 22, and FIG. 24 is a cross-sectional view showing combination of the spray nozzle and the top cover according to the fifth embodiment of the present invention.

Referring to FIGS. 22 and 23, the spray nozzle 150 is aligned with the initial fitting position N1, and then rotated clockwise at a predetermined angle W. Hereinafter, the predetermined angle W is referred to as a spray nozzle rotating angle.

The spray nozzle rotating angle W is determined in advance when the side direction spray angle H is set. The side direction spray angle H represents an angle at which washing water is sprayed to the inner sidewall of the inner tub 6 and the spray nozzle rotating angle W is a design parameter for determining the position and length of the rear protrusion combining hole 174 and the position of the elastic protrusion combining hole 184 in order to set the side direction spray angle H.

When the spray nozzle 150 is rotated clockwise by the spray nozzle rotating angle W, the rear protrusion 172 is rotated along the insertion part 174*b* of the rear protrusion combining hole 174 to be disposed in a fitting completion position N2.

When the spray nozzle 150 is rotated, the elastic protrusion 182 is located in front of the elastic protrusion combining hole 184 and inserted into the elastic protrusion combining hole 184 by elasticity.

Accordingly, the spray nozzle 150 can be rotated from the initial fitting position N1 by the spray nozzle rotating angle W to be disposed in the fitting completion position N2.

Referring to FIG. 23, when the spray nozzle 150 is rotated to the fitting completion position N2, the rear protrusion 172 and the radius protrusion 176 are disposed on the backside of the top cover 103 and fixed. Accordingly, the spray nozzle 150 can be prevented from moving forward and backward.

Furthermore, the elastic protrusion 182 is inserted into the elastic protrusion combining hole 184 and fixed in the rotating direction, and thus the spray nozzle 150 can be prevented from moving in the rotating direction thereof.

Figure 25:
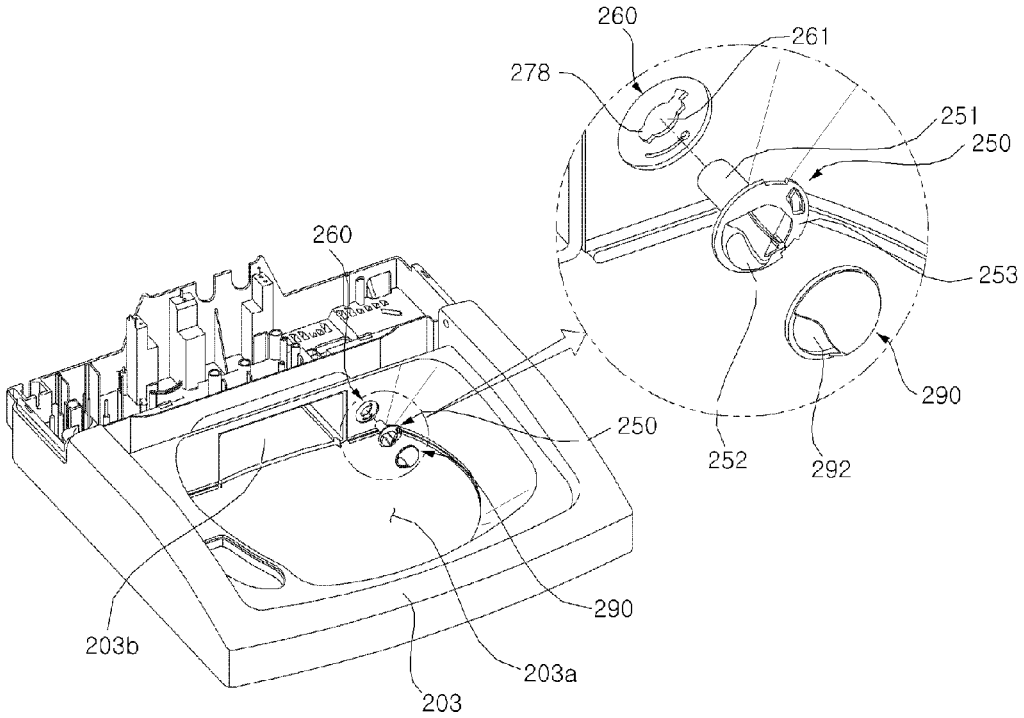
FIG. 25 is a perspective view showing a structure of combination of a top cover, a spray nozzle and a nozzle cap of a fabric treating machine according to a sixth embodiment of the present invention.
Figure 26:
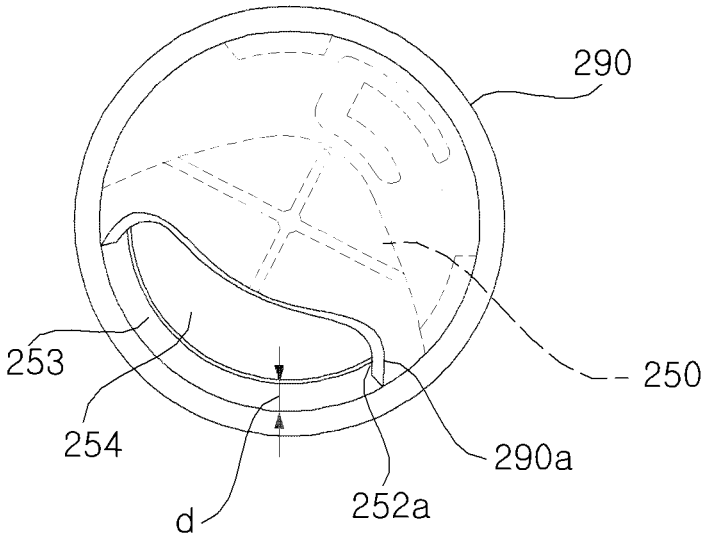
FIG. 26 is a perspective view showing combination of the spray nozzle and the nozzle cap shown in FIG. 25.
Figure 27:
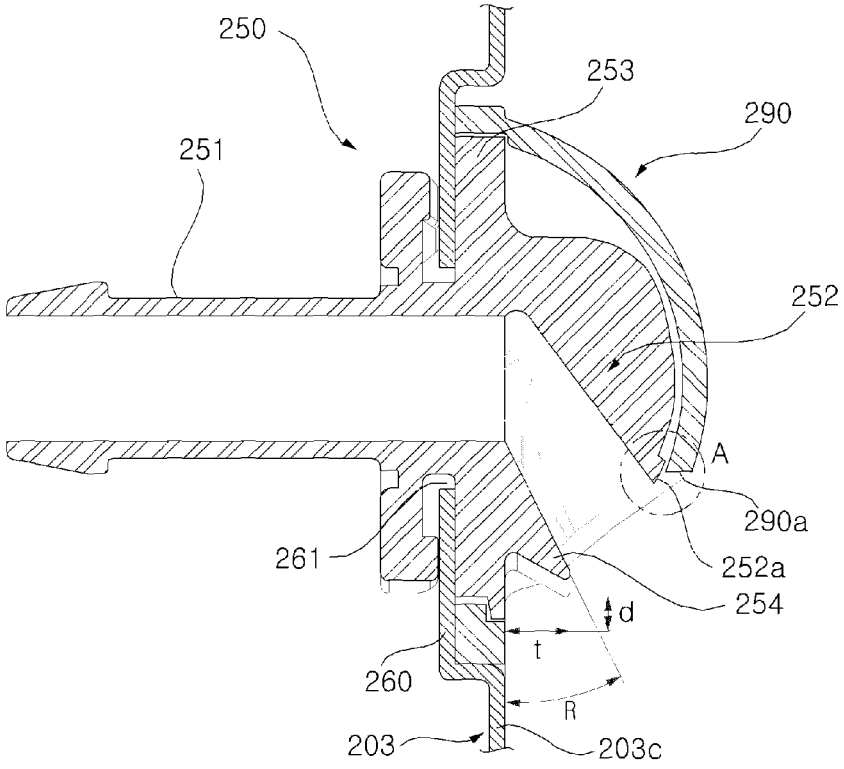
FIG. 27 is a cross-sectional view of the spray nozzle combined with the top cover according to the sixth embodiment of the present invention.
Figure 28:
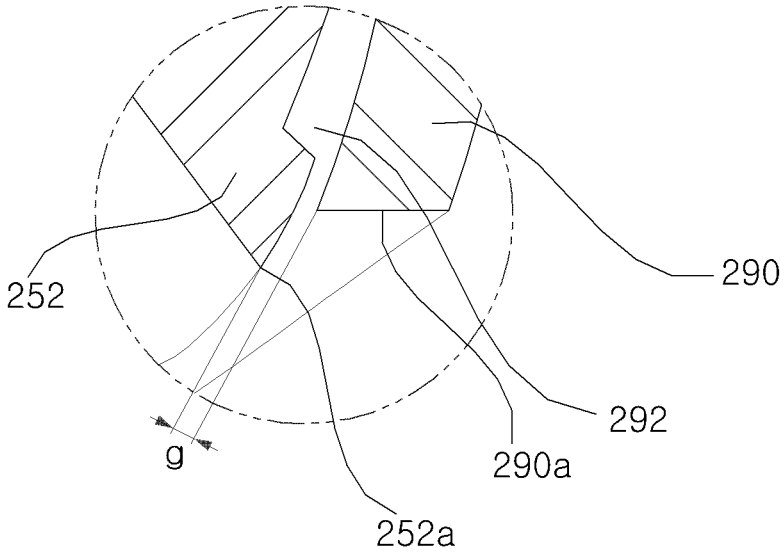
FIG. 28 is an enlarged view of portion A shown in FIG. 27.
Figure 29:
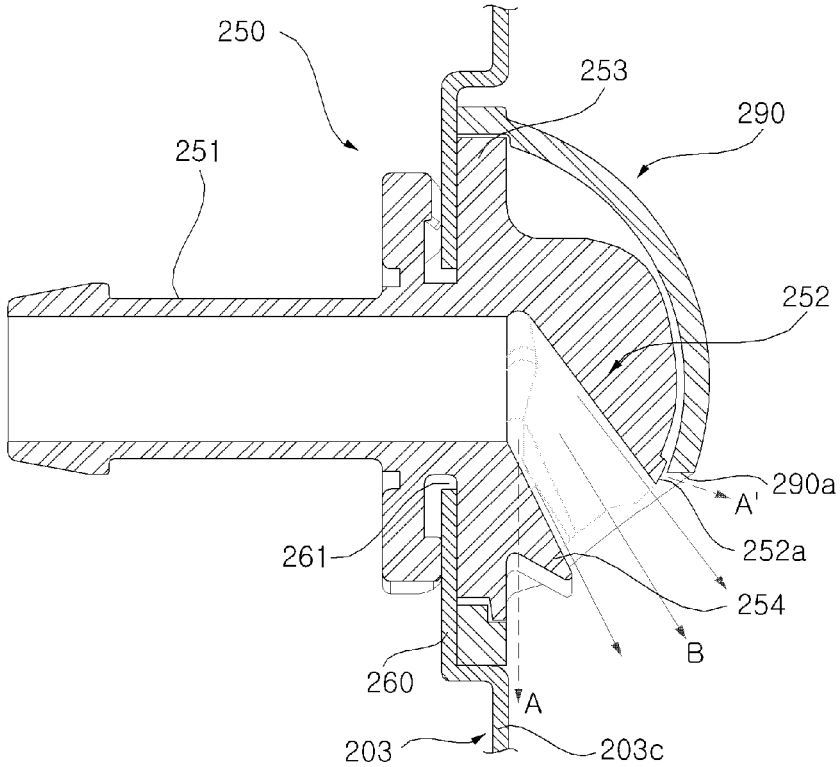
FIG. 29 is a cross-sectional view showing a spray direction of washing water sprayed through the spray nozzle according to the sixth embodiment of the present invention.

FIG. 25 is a perspective view showing a structure of combination of a top cover, a spray nozzle and a nozzle cap of a washing machine according to a sixth embodiment of the present invention, FIG. 26 is a perspective view showing combination of the spray nozzle and the nozzle cap shown in FIG. 25, and FIG. 27 is a cross-sectional view of the spray nozzle combined with the top cover according to the sixth embodiment of the present invention. FIG. 28 is an enlarged view of portion A shown in FIG. 27 and FIG. 29 is a cross-sectional view showing a spray direction of washing water sprayed through the spray nozzle according to the sixth embodiment of the present invention.

Referring to FIGS. 25 through 29, the washing machine according to the sixth embodiment of the present invention includes a spray nozzle 250 for spraying water supplied from a water supply passage to the inside of the inner tub 6 and a nozzle cap 290 covering the spray nozzle 250 to be combined with the spray nozzle 250. The spray nozzle 250 includes a projection 254 formed at a lower portion of the front face of the spray nozzle 250 to prevent washing water from flowing on the front side of the case. The projection 254 is further protruded than the front side of the case. Configurations and actions of components other than the spray nozzle 250 of the washing machine according to the sixth embodiment of the present invention are identical to those of the washing machine according to the fifth embodiment of the present invention so that detailed explanations thereof are omitted.

The spray nozzle 250 is fitted in the case. The spray nozzle 250 is fitted in a top cover 203 of the case in the current embodiment of the present invention.

A detergent box installing part 203*b* is formed at one side of the top cover 203, which faces a fabric entrance 203*a*, and a spray nozzle combining part 260 in which the spray nozzle 250 is fitted is formed.

The spray nozzle 250 includes a tube 251 connected with a water supply hose (not shown) for the nozzle to guide water, a spraying unit 252 extended from the end of the tube 251 to spray water, and a reinforcing plate 253 extended in the radius direction between the tube 251 and the spraying unit 252 to reinforce the strength of combination of the top cover 203 and the spray nozzle 250.

The tube 251 is inserted into the spray nozzle combining part 260 of the top cover 203. The spray nozzle combining part 260 has a tube insertion hole 262 into which the tube 251 is inserted. The tube insertion hole 261 corresponds to the shape of the tube 251.

Referring to FIG. 27, the projection 254 is formed on a lower portion of the front face of the spraying unit 252 and is further protruded than the front side 203*c* of the top cover 203.

The projection 254 is further protruded than the front side 203*c* of the top cover 203 in the forward direction by a predetermined length t and inclined at a predetermined angle R from the front side 203*c* of the top cover 203. Hereinafter, the predetermined length t is referred to as a projection length and the predetermined angle R is referred to as an inclination angle R.

The projection length t and the inclination angle R of the projection 254 are determined in advance according to experiments. That is, the projection length t and the inclination angle R of the projection 254 may be determined in consideration of a spray direction of washing water, which depends on water pressure.

For example, the projection length t of the projection 254 may be set to about 4 mm and the inclination angle R of the projection 254 may be set to about 26°.

The projection 254 prevents washing water sprayed through the spraying unit 252 from flowing on the front side of the top cover 203 when water pressure is low or an amount of water supply is small. If the washing water sprayed through the spraying unit 252 flows over the front side of the top cover 203, the spray direction and spray range of the washing water are deviated from a predetermined direction, and thus fabric loaded in the inner tub cannot be evenly soaked.

It is preferable that the external diameter of the projection 254 is smaller than the external diameter of the reinforcing plate 253. That is, the projection 254 may be smaller than the reinforcing plate 253 by a predetermined length d.

A nozzle 252*a* for spraying washing water is formed at the bottom of the spraying unit 252.

An opening 290*a* corresponding to the nozzle 252*a* is formed in the nozzle cap 290.

The opening 290*a* is larger than the nozzle 252*a* of the spraying unit 252 to prevent washing water sprayed through the nozzle 252*a* from flowing over the surface of the nozzle cap 290 according to surface tension.

A gap 292 corresponding to a predetermined distance g is formed between the spraying unit 252 and the nozzle cap 290 in the forward/backward direction. That is, the nozzle 252*a* of the spraying unit 252 and the opening 290*a* of the nozzle cap 290 do not come into contact with each other and the gap 292 is formed between the nozzle 252*a* and the opening 290*a*, and thus washing water sprayed through the nozzle 252*a* can be prevented from flowing over the surface of the nozzle cap 290.

Referring to FIG. 29, washing water flowing through the tube 252 into the spray nozzle 250 is sprayed in a direction B inclined downward through the spraying unit 252.

The washing water discharged through a lower portion of the spraying unit 252 may be sprayed along the surface of the projection 254 to the direction B inclined downward. Since the spraying unit 252 is separated from the front side 203*c* of the top cover 203 by the projection length t of the projection 254, the washing water discharged through the spraying unit 252 can be prevented from flowing to the direction A of the front side 203*c* of the top cover 203.

Washing water discharged through an upper portion of the spraying unit 252 is sprayed to the direction B inclined downward along an upper spray face of the spraying unit 252. Since the nozzle 252*a* of the spraying unit 252 and the opening 290*a* of the nozzle cap 290 have the gap 292 between them, the washing water sprayed from the nozzle 252*a* can be prevented from flowing to the direction A' of the nozzle cap 290.

Accordingly, a predetermined washing water spray direction and spray range can be secured irrespective of a variation in water pressure or the amount of water supply.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A fabric treating machine comprising:

a case having a fabric entrance formed at the top thereof;

an inner tub disposed in the case;

a water supply unit for supplying water;

a spray nozzle causing a stream of water supplied from the water supply unit to impinge on a surface such that the stream breaks up into drops and is sprayed into the inner tub;

wherein an elastic protrusion extends from the spray nozzle, and an elastic protrusion coupling hole is formed on a face of the case, and wherein the spray nozzle is configured to be rotatably coupled to the face of the case in a manner so that as the spray nozzle is being rotatably coupled to the face of the case, the elastic protrusion is elastically bent by abutment with the face of the case, and after the spray nozzle has been rotated through a predetermined angle, the elastic protrusion is inserted into the coupling hole of the face which restricts any further rotation of the spray nozzle.

2. The fabric treating machine of claim 1, wherein the spray direction of the spray nozzle is determined according to the rotation of the spray nozzle.

3. The fabric treating machine of claim 1, further comprising a first combining unit disposed in one of the spray nozzle and the case and inserted into the other in a forward/backward direction to guide the spray nozzle to a fitting position when the spray nozzle is fitted in the case and fixed in the forward/backward direction when the spray nozzle is rotated at a predetermined angle to prevent the spray nozzle from moving in the forward/backward direction.

4. The fabric treating machine of claim 3, wherein the first combining unit comprises:

a rear protrusion formed on the spray nozzle and protruded backward toward the case; and a rear protrusion combining hole formed in the shape of an arch in the case such that the rear protrusion is inserted into the rear protrusion combining hole and rotated along the arch at a predetermined angle.

5. The fabric treating machine of claim 4, wherein the rear protrusion combining hole comprises:

an insertion part into which the rear protrusion is inserted in the forward/backward direction; and a rotating part extended from the insertion part in the rotating direction of the spray nozzle to form an arch shape, the area of the rotating part being smaller than that of the insertion part.

6. The fabric treating machine of claim 1, wherein one face of the elastic protrusion is connected to the spray nozzle to form a connection portion and three faces of the elastic protrusion are cut to form an elastic portion having elasticity in the forward/backward direction about the connection portion.

7. The fabric treating machine of claim 1, wherein the elastic protrusion has a rear face at the protruding end and the rear face is inclined about to the face of the case.

8. The fabric treating machine of claim 3, wherein the spray nozzle comprises a tube fitted in the case, and the first combining unit comprises a radial protrusion protruding from the tube in the direction of the radius of the tube and a radial protrusion hole formed in the case, the radial protrusion being inserted into the radial protrusion hole.

9. The fabric treating machine of claim 1, wherein a projection is formed at a lower portion of a front face of the spray nozzle and is further protruded than a front side of the case to prevent the washing water sprayed downward from flowing over the front side of the case.

10. The fabric treating machine of claim 9, wherein the projection is inclined at a predetermined angle to the front side of the case.

11. The fabric treating machine of claim 9, further comprising a nozzle cap covering the spray nozzle, wherein a predetermined gap is formed between the spray nozzle and the nozzle cap in the forward/backward direction and washing water sprayed through the spray nozzle is prevented from flowing over the nozzle cap.

12. The fabric treating machine of claim 1, wherein the elastic protrusion is stopped by a peripheral portion of the elastic protrusion coupling hole of the case.

13. The fabric treating machine of claim 1, wherein the spray nozzle comprises a tube through which the water flows towards said surface, the tube having an inner bore, and said surface being arranged to cover an entire axial projection of the bore.

* * * * *